United States Patent [19]

Hamm

[11] Patent Number: 5,059,753

[45] Date of Patent: Oct. 22, 1991

[54] SF6 PUFFER RECLOSER

[75] Inventor: Sidney R. Hamm, Muskego, Wis.

[73] Assignee: Cooper Industries, Inc., Houston, Tex.

[21] Appl. No.: 329,464

[22] Filed: Mar. 28, 1989

Related U.S. Application Data

[63] Continuation-in-part of Ser. No. 117,604, Nov. 6, 1987, Pat. No. 4,841,108, and Ser. No. 282,700, Dec. 9, 1988, Pat. No. 4,965,407.

[51] Int. Cl.[5] ..... H01H 33/42; H01H 33/88

[52] U.S. Cl. ..... 200/148 F; 200/148 R; 200/148 A; 200/148 B

[58] Field of Search ..... 200/148 R, 148 A, 148 B, 200/148 F

[56] References Cited

U.S. PATENT DOCUMENTS

| | | | |
|---|---|---|---|
| 3,163,735 | 12/1964 | Miller | 200/144 |
| 3,164,706 | 1/1965 | Johnson | 200/148 |
| 3,527,912 | 9/1970 | Jaillet | 200/148 A |
| 3,639,712 | 2/1972 | Balmat et al. | 200/148 A |
| 3,814,883 | 6/1974 | Milianowicz | 200/148 G |
| 4,027,125 | 5/1977 | Peek et al. | 200/148 R |
| 4,046,978 | 9/1977 | Badon | 200/148 A |
| 4,144,426 | 3/1979 | Kowalik et al. | 200/148 A |
| 4,152,560 | 5/1979 | McCloud et al. | 200/148 R |
| 4,163,131 | 7/1979 | Perkins | 200/148 A |
| 4,249,051 | 2/1981 | Votta | 200/147 R |
| 4,249,052 | 2/1981 | Votta et al. | 200/147 R |
| 4,253,002 | 2/1981 | Kii | 200/148 R |
| 4,259,554 | 3/1981 | Smith et al. | 200/147 R |
| 4,259,556 | 3/1981 | Kii | 200/148 R |
| 4,264,794 | 4/1981 | Kii | 200/148 XA |
| 4,268,733 | 5/1981 | Garzon | 200/150 G |
| 4,276,456 | 6/1981 | Cromer et al. | 200/148 A |
| 4,309,581 | 1/1982 | Macquire et al. | 200/148 R |
| 4,328,403 | 5/1982 | Frink et al. | 200/148 A |
| 4,354,072 | 10/1982 | Noeske | 200/148 A |
| 4,371,766 | 2/1983 | Huser | 200/148 A |
| 4,393,290 | 7/1983 | Mittelbach et al. | 200/148 A |
| 4,434,334 | 2/1984 | Traggesser | 200/148 R |
| 4,475,019 | 10/1984 | Tragesser | 200/148 A |
| 4,489,226 | 12/1984 | Holmgren et al. | 200/148 A |
| 4,663,504 | 5/1987 | Barkan | 200/148 A |

*Primary Examiner*—Robert S. Macon

*Attorney, Agent, or Firm*—Gregory L. Maag; David A. Rose

[57] ABSTRACT

A distribution class recloser comprises puffer type, compressed-gas circuit interrupters and a spring stored energy operating mechanism. The interrupter includes a single pair of elongated and axially aligned contacts, one of which is moveable and includes a plurality of flexible contact fingers for engagine the stationary contact. The contacts include arcing tips formed on the terminus portions thereof for conducting arcing current. Additionally, the contact fingers on the moveable contact include raised, wedge-shaped electrical connections. When the moveable contact engages the stationary contact, the raised connections flex the fingers outward so as to cause the arcing tips of the moveable contact to move out of contact with the stationary contact to allow the raised electrical connections to carry the continuous current. It has been found that an interrupter of this design in which the same set of contacts carry both the arcing current and the continuous, steady state current may be made smaller, lighter in weight, and less costly, and thus can be employed in an recloser application and actuated by means of a spring stored energy operating mechanism. The operating mechanism employs opening springs and closing springs for actuating the interrupters by means of a mechanical linkage and actuator shafts, one of which extends through the housing of each interrupter. A modular rotary seal assembly is also provided which provides both a bearing and a seal for the actuator shafts and which employs no metal-to-metal components.

56 Claims, 16 Drawing Sheets

SF6 PUFFER RECLOSER

RELATED APPLICATIONS

This application is a continuation-in-part of U.S. Pat. application No. 117,604, filed Nov. 6, 1987, now U.S. Pat. No. 4,841,108, issued June 20, 1989, and of U.S. Pat. application No. 282,700. filed Dec. 9, 1988 now U.S. Pat. No. 4,965,407 issued Oct. 23, 1990.

BACKGROUND OF THE INVENTION

This invention relates generally to electrical power distribution equipment. More particularly, the invention relates to recloser apparatus. Still more particularly, the invention relates to a distribution class recloser employing $SF_6$ puffer interrupters and a spring stored energy operating mechanism.

In general, a recloser is a circuit breaking or interrupting device used in the distribution of three phase electrical power. Like a circuit breaker, when a sensor or protective relay detects a fault or other system disturbance on the circuit, the recloser operates to physically separate current-carrying contacts in each phase and thereby opens the circuit and prevents the continued flow of current. A recloser differs from a circuit breaker in that a circuit breaker opens a circuit and maintains the circuit in the open position indefinitely, while a recloser operates to automatically open and reclose the circuit several times in quick succession according to a predetermined pattern. By momentarily opening and then reclosing the circuit, the recloser allows temporary faults repeated chances to clear or be cleared by subordinate protective devices. Should the fault not clear after the recloser has completed its programmed sequence of open-close operations, the recloser recognizes the condition as a permanent fault and locks the circuit open. In cooperation with the various protective relays or sensors, the recloser thus has the ability to distinguish between temporary and permanent faults on a circuit. The use of a recloser to reclose a circuit several times often prevents taking a circuit out of service when the fault or disturbance on the line was of a momentary duration only.

The major components of a recloser are the interrupters, which function to open and close the set of current carrying contacts housed therein, and the operating mechanism which, upon receipt of the appropriate control signal, provides the energy necessary to open or close the contacts. A mechanical linkage connects the interrupters and the operating mechanism.

All circuit interrupting devices can be generally classified by the type of interrupting media used to extinguish the arc that is formed as the current carrying contacts are separated, such media including air, oil, vacuum and, most recently, sulfur hexafluoride gas ($SF_6$). To date, manufacturers have predominantly used oil or vacuum interrupters in recloser applications. The outstanding insulating and interrupting properties of $SF_6$ gas are well known; however, the application of $SF_6$ technology has a primarily been reserved for high-voltage applications, such as 69 KV and above, as generally it has not been economically attractive to utilize the $SF_6$ interrupters in distribution class equipment, generally defined as 38 KV and below.

At present, the two predominate types of $SF_6$ interrupters are the magnetic interrupter and the puffer interrupter. Magnetic type $SF_6$ interrupters magnetically move the arc through the gas and are typically used in breaker applications where high interrupting capacities are not required. Puffer type interrupters typically use a piston to compress $SF_6$ gas in one portion of the interrupter and then force the gas through a nozzle and across the arc so as to quickly extinguish the arc. The puffer technique is normally used in applications requiring a high interrupting capability.

Because the power distribution system typically dictates that reclosers have a high interrupting capability, if $SF_6$ interrupters were to be employed in a recloser, it would be desirable to use a puffer interrupter. Unfortunately, compared to other interrupters, the mass of the conventional $SF_6$ puffer interrupters requires a relatively large operating mechanism or prime mover to perform the circuit opening and closing function. For this reason, the use of $SF_6$ puffer interrupters has primarily been limited to high voltage circuit breaker applications where the cost of the operating mechanism is a small part of the total cost of the interrupter as compared to their proportionate costs in distribution class equipment.

The requirement of a relatively large or high energy operating mechanism makes the use of a conventional $SF_6$ puffer interrupter economically unattractive or impractical in distribution class equipment such as reclosers, despite the otherwise advantageous characteristics of $SF_6$ gas and puffer technology. Accordingly, there is a need in the art for a recloser employing $SF_6$ puffer interrupters that does not require the large, high energy operating mechanisms now employed on the higher voltage class equipment. Ideally, the recloser would employ $SF_6$ puffer interrupters that are smaller, lighter and internally less complex than those of the prior art. This would lower the cost of the puffer interrupters themselves. It would also allow the use of relatively low energy operating mechanism or prime mover and thereby lower the total cost of the recloser. A smaller recloser also allows the recloser to become an integrated assembly which can be mounted in a cabinet that is fabricated from one piece of material. Further, an integrated assembly does not require assembly in sections and subsequent adjustment. Thus, costs are reduced and assembly time is saved.

SUMMARY OF THE INVENTION

The present invention provides a circuit recloser for use in the distribution of three-phase electrical power. The invention generally includes an improved puffer type, compressed gas circuit interrupter and a spring stored energy operating mechanism.

In accordance with one aspect of the present invention, there is provided a circuit interrupter for interrupting current flow and extinguishing the resultant arc, the interrupter including a housing which contains an arc-extinguishing media such as $SF_6$ gas, a pair of contacts disposed within the housing and moveable between an opened and closed position, and a means for injecting a blast of the arc-extinguishing media into the gap that is formed as the contacts are opened. The invention additionally includes an operating mechanism for moving the contacts between the closed and opened position and for reclosing the contacts after a predetermined interval.

In the preferred embodiment, the contacts include a moveable and a stationary contact, the moveable contact including flexible contact fingers for engaging the stationary contact as the contacts are closed by the operating mechanism. Both contacts include arcing tips for conducting the arcing current. In addition, the arcing fingers on the moveable contact include raised, wedge-shaped electrical connections for carrying the continuous, steady state current after the contacts are closed. These raised connections act to flex the fingers outwardly as the moveable contact engages the stationary contact, causing the arcing tips to move out of contact with the stationary contact. This contact arrangement in which this same contacts carry both the continuous, steady state current and the arcing current eliminates the requirement of a separate set of main current-carrying contacts for carrying continuous currents as used in conventional puffer type interrupters. These conventional puffer interrupters typically required that the piston employed to provide the blast of arc-extinguishing gas itself be conducting. The present invention, which does not utilize multiple sets of contacts, likewise does not require that the piston be a conducting member and thus allows the use of smaller and lighter weight components. The simplification of the present interrupter design and the decrease in size and weight of interrupter components allows the puffer interrupter of this invention to be employed in a recloser application where the recloser must be able to withstand more than two hundred interrupting operations to meet current industry standards and where the interrupters and operating mechanism must undergo much harsher duty than in a circuit breaker application, such duty including, for example, up to four open-close sequences in less than ten seconds. The unique puffer interrupter design of the present invention also permits the use of a spring stored energy operating mechanism, as opposed to the more expensive and heavier pneumatic or hydraulic closing mechanisms employed with other puffer interrupters.

The invention further comprises a rotary seal assembly which provides both a bearing and a seal for a rotating shaft used to transmit a torque into the pressurized interrupter housing. The rotary seal assembly is a modular assembly which facilitates assembly and disassembly of the interrupter, allows for the interchangeability of seal components between interrupters, and eliminates certain fine machining of interrupter housings otherwise required, thus lowering both the initial and maintenance costs of the interrupters.

The inventive seal assembly includes a seal housing module and a bearing housing module which have aligned axial bores formed therethrough. The interrupter actuator shaft is disposed through these bores and through the coaxial bore formed in the interrupter housing. An 0-ring seal is disposed in an upper groove formed in the seal housing module and seals the assembly against the interrupter housing. A rotary seal is disposed in a groove formed between the seal housing module and the bearing housing module and seals against the actuator shaft. Teflon bearings or bearings coated with teflon or another nonmetallic insulative material support the actuator shaft within the seal assembly.

This unique seal assembly eliminates all metal-to-metal moving parts and thus, eliminates the resultant metal filings which can lead to seal or interrupter failure. The components of the seal assembly are interchangeable. In addition, the close tolerances and fine machining typically required for bearing and sealing surfaces on conventional interrupter housings are not required since, to the extent that fine machining is required, it is performed on the interchangeable housing modules. Whereas in the past, if an interrupter seal failed, it was usually necessary to remove the interrupter from service and perform repairs or rework the interrupter housing, the seal assembly eliminates the need for rework to the housing and, with the feature of interchangeable components, allows the seal to be repaired or replaced quickly, thus eliminating costly down time.

The present invention further includes bushings mounted on the interrupter housing for connecting the interrupter contacts to the power circuit. The bushings include a skirted weathershed molded directly to an internal conductor and include a cavity in the lower end of the weathershed at the base of the bushings, the cavity being in fluid communication with the interior of the interrupter housing and also filled with the arc-extinguishing gas. The base of the bushings include a seal for preventing leakage of the dielectric gas at the connection between the bushings and the interrupter housing. The bushing, with its dielectric cavity, allows the bushing to be smaller than conventional bushings, decreasing the weight and material cost of the bushing, yet still having the dielectric strength of the larger, more expensive conventional bushings.

Numerous other advantages and features of the present invention will become readily apparent in the following detailed description of the invention and the preferred embodiments described therein.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
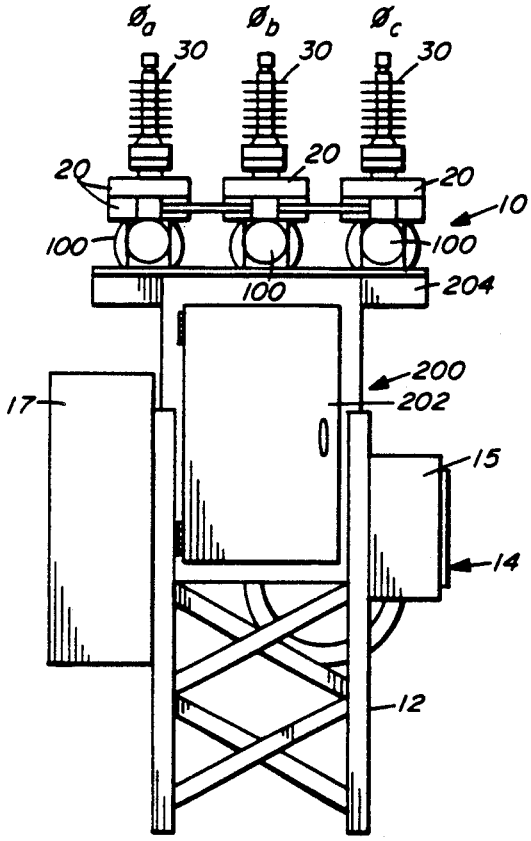
FIG. 1 shows a front elevation view of the $SF_6$ recloser of the present invention.
Figure 2:
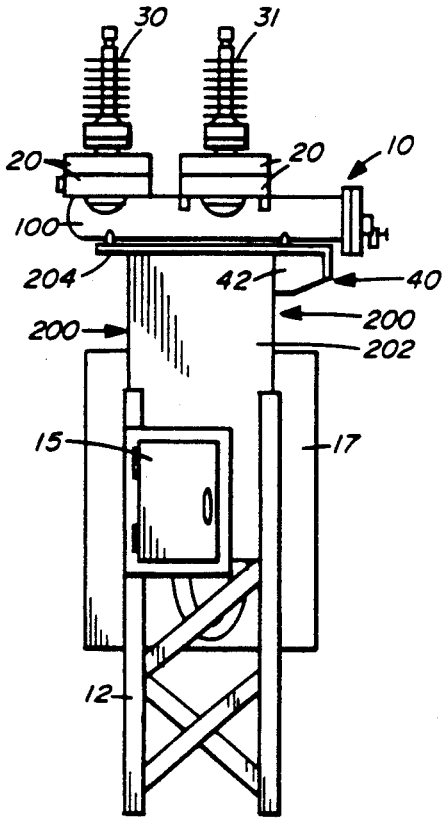
FIG. 2 shows a side elevation view of the $SF_6$ recloser shown in FIG. 1.

Referring initially to FIGS. 1 and 2, there is shown a $SF_6$ puffer recloser 10 having a compact design and generally comprising three single-phase puffer interrupters 100, each having a pair of bushings 30, 31 for connection with line-side and load-side phase conductors, and further comprising an operator 200 for actuating interrupters 100 to open and close internal current-carrying contacts in response to the receipt of a programmed sequence of "trip open" and "trip closed" signals from a controller 14 housed in control cabinet 15. Operator 200 is housed within enclosure 202 which is supported by and attached to a frame 12. Frame 12 is shown free-standing for substation mounting, but may alternatively be adapted for pole mount applications. Weathershed 204 forms the top or cover of enclosure 202 and serves to support puffer interrupters 100 which are fastened to weathershed 204 in a parallel configuration by cap screws 206 (shown in FIG. 3) or other suitable fasteners. The puffer interrupters 100 are mechanically linked to the operator 200 by phase linkage 40 and mounted together atop operator enclosure 202 whereby the operator 200 can simultaneously open or close the contacts in each puffer interrupter 100 via phase linkage 40 upon receipt of "trip open" or "trip closed" signals. Recloser 10 is of the "dead tank" construction, meaning that frame 12, interrupters 100, and operator 200 are all electrically grounded.

Each puffer interrupter 100 includes line-side bushing 30, for connection to an incoming or line-side phase conductor, and service-side bushing 31, for connection to the corresponding service or load-side phase conductor. Each puffer interrupter 100 functions to interrupt one phase of the three-phase power distribution circuit. As depicted in FIG. 1, interrupters 100, from left to right, may service phases a, b and c, respectively.

As shown in FIG. 2, an enclosure 42 is positioned between operator enclosure 202 and weathershed 204 and houses phase linkage 40. Phase linkage 40, described below and shown in detail in FIG. 12, actuates puffer interrupters 100 upon actuation and operation of operator 200.

The puffer interrupters 100, phase linkage 40 and operator 200 are integrated together to form one integrated recloser assembly 10. This integration allows cabinet 202 to be fabricated from one piece of material thereby eliminating substantial waste. As an integrated assembly, recloser 10 is not assembled in sections and the mountings may be located upon assembly of the housing 202 without requiring subsequent adjustment. This integration saves cost of materials and assembly time.

A control cabinet 15, also supported by operator enclosure 202, houses a programmed controller 14 which includes the various electronic devices that determine the recloser sequencing functions. A relay cabinet 17 may also be attached to enclosure 202 or frame 12 for housing over-current relays 16 and other protective devices and sensors used to detect the existence of a fault or system disturbance which may be of sufficient magnitude so as to activate recloser 10.

When a fault or other system disturbance of a predetermined magnitude is detected on one or more phases of the three-phase power distribution circuit, controller 14 will transmit a "trip open" signal to operator 200 of $SF_6$ puffer recloser 10. Upon receipt of that signal, operator 200 will initiate a sequence of open and close operations, that sequence being preprogrammed into the controller 14 by the owner of the recloser 10. The sequence is initiated by the controller 14 sending a "trip open" signal to an open actuator 210 in operator 200, shown in FIG. 13. Open actuator 210 unlatches a plurality of opening springs 300, also shown in FIG. 13, and uses spring stored energy to quickly separate the current carrying contacts 144, 146, shown in FIG. 5, in each $SF_6$ puffer interrupter 100 by means of phrase linkage 40. After a preset interval, typically a matter of a second or two, the recloser controller 14 sends a "trip closed" signal to a close actuator 230 in operator 200, shown in FIG. 13. Close actuator 230 unlatches a plurality of charged closing springs 400 which provide spring stored energy to quickly reengage or close current carrying contacts 144, 146 in each $SF_6$ puffer interrupter 100 by means of phase linkage 40. If the fault or disturbance is no longer present, these contacts 144, 146 remained closed and the circuit thus returns to its steady state condition. If the fault has not cleared, controller 14 again signals the operator 200 to actuate the puffer interrupters 100 pursuant to the preprogrammed sequence of controller 14, thereby opening the three-phase circuit until a second closing operation, if programmed, is initiated. If the fault persists after the prescribed number of open and close operations have taken place, the circuit is again opened and the operator 200 becomes locked out such that the interrupter contacts 144, 146 are locked in the open position.

Interrupter 100

Figure 3:
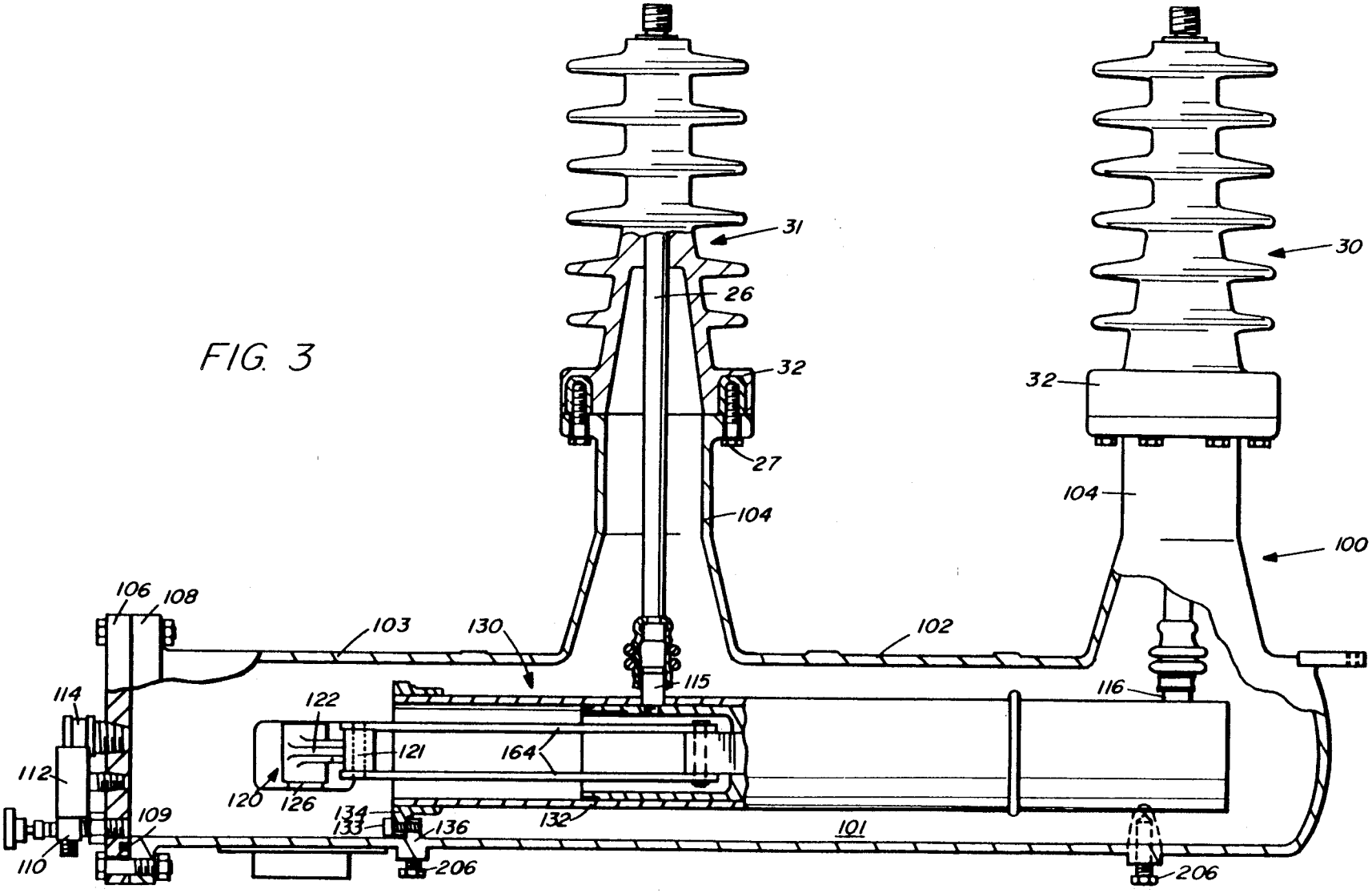
FIG. 3 shows an elevation view, partly in cross section, of the seal assembly and actuator of the puffer interrupter of the $SF_6$ recloser shown in FIG. 1.

Referring now to FIG. 3, puffer interrupter 100 generally comprises an actuator 120 and interrupter subassembly 130 disposed within a housing 102. Housing 102 encloses actuator 120 and interrupter subassembly 130 within a dielectric chamber 101 which is adapted to retain therein an arc-extinguishing media such as sulfur hexafluoride gas ($SF_6$). The $SF_6$ gas is used to extinguish the arc formed when the interrupter contacts 144, 146 (FIG. 5) separate, and also serves as a dielectric shield, allowing the highly energized internal components of interrupter 100 to be in relatively close proximity to one another without flash over occurring.

Figure 11:
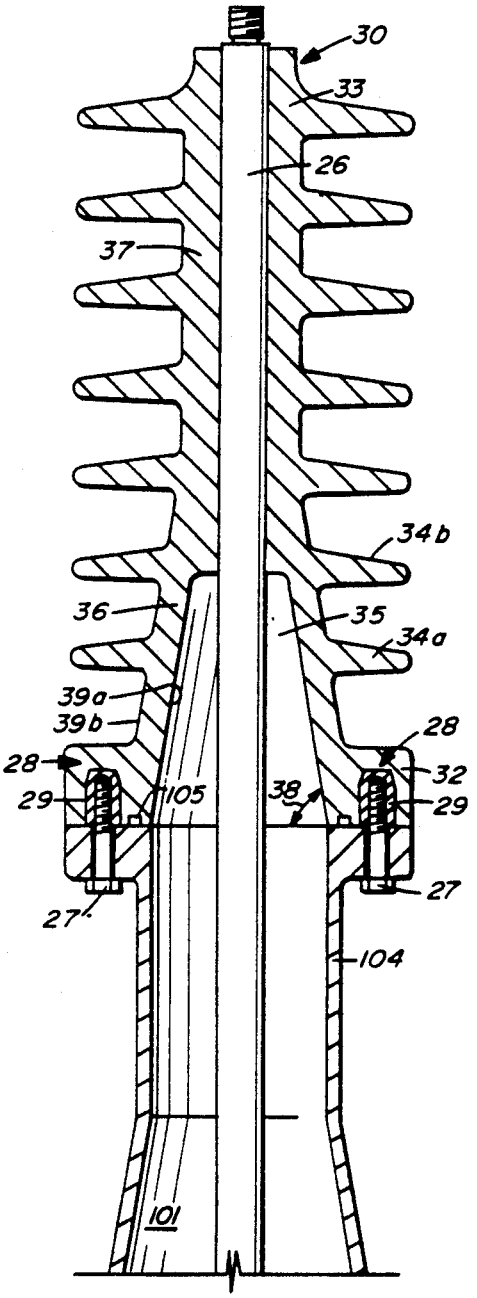
FIG. 11 shows a section view of a bushing attached to the interrupter shown in FIG. 3.

Housing 102, which preferably is manufactured of cast aluminum, includes a generally cylindrical body 103, a closure 106 and a pair of bushing pedestals 104 for mounting bushings 30, 31. Bushings 30, 31, described in more detail below, have a flanged base 32 which rests upon and is attached to bushing pedestals 104 by cap screws 27 or other suitable fasteners. O-ring seal 105, shown in FIG. 11, is disposed within an annular groove formed in base 32 and prevents escape of the $SF_6$ gas at the connection between bushings 30, 31 and bushing pedestal 104. Bushing pedestals 104 also serve to support up to three bushing current transformers 20 (two shown in FIGS. 1 and 2) used to sense current flow through interrupters 100 and to signal controller 14, or alternatively relays 16, if an over-current or fault condition exists. Referring again to FIG. 3, closure 106 is bolted or otherwise suitably attached to flange 108 of enclosure body 103. An O-ring seal 109 is disposed within an annular groove formed in closure 106 and prevents the $SF_6$ gas from escaping between flange 108 and closure 106. Threaded bores are provided in closure 106 for the insertion of fill valve 110, pressure gauge 112 and rupture disk 114.

Bushings 30, 31

Referring now to FIG. 11, there is shown a bushing 30, typical of the bushings 30, 31 used in the present invention. Bushing 30 generally comprises a conductor 26, a dielectric cavity 35 and a weathershed 33. Conductor 26 comprises a conducting rod formed of copper or aluminum and adapted for connection at its upper end to either line-side or service side phase conductors and at its lower end to contact studs 115, 116 of interrupter 100. Weathershed 33 is molded around conductor 26 and insulates conductor 26 from all adjacent conducting surfaces.

Weathershed 33 is molded from an insulating material such as an epoxy resin, and preferably is made of cycloaliphatic epoxy resin which is suitable for outdoor use, and is particularly suited for retaining $SF_6$ gas or other dielectric media within dielectric cavity 35. Weathershed 33 is generally cone-shaped having a lower conical portion 36 and an upper cylindrical riser portion 37. Formed within lower conical portion 36 is dielectric cavity 35, cavity 35 being in fluid communication with the dielectric chamber 101 of interrupter 100 when bushing 30 is mounted on bushing pedestal 104. The lower conical portion 36 is formed in a shape of a truncated cone having a cone angle 38 preferably greater than 80°. Integrally formed about lower portion 36 is flanged base 32 for engagement with the upper surface of bushing pedestal 104. Flanged base 32 is diametrically larger than the cylindrical riser portion 37 so as to contribute to the overall stability of bushing 30 when mounted on interrupter 100. As is apparent from FIG. 11, base 32, lower conical portion 36 and cylindrical riser portion 37 are integral and continuous in forming weathershed 33.

Weathershed 33 includes a plurality of annular fins or skirts 34 spaced along the exterior of weathershed 33. Skirts 34 preferably have a common outer diameter, are coaxially aligned and are substantially equally spaced along the length of weathershed 33. The underside of each skirt 34 is preferably parallel to the lower surface of flanged base 32. The upper side of each skirt 34 is preferably downwardly slopped to prevent drainage of water or other accumulants.

As shown in FIG. 11 dielectric cavity 35 is molded within the lower conical portion 36 of weathershed 33. The upper most portion of cavity 35 terminates colinearly with the second skirt **34*b*. Cavity 35 is formed with smooth inner walls. The interior and exterior surfaces 39*a*, 39*b* respectively of lower conical portion 36 are substantially parallel so as to form a uniform wall thickness between skirts 34*a* and 35*b* adjacent cavity 35**.

Flanged base 32 includes an annular groove in which is disposed an annular seal or gasket 105 of rubber or synthetic elastomer material. Seal 105 retains a gas-tight seal between bushing pedestal 104 and flanged base 32 of bushing 30. Flanged base 32 also includes a plurality of anchors 28, preferably six, spaced about the circumference of flanged base 32. A prethreaded aluminum insert 29 is molded into each anchor for threaded engagement with a cap screw 27 or other suitable fastener which secures bushing 30 to bushing pedestal 104.

The bushings 30, 31 of the present invention are further described in U.S. Pat. application Ser. No. 282,700 filed Dec. 9, 1988, incorporated herein by reference.

Subassembly 130

Figure 5:
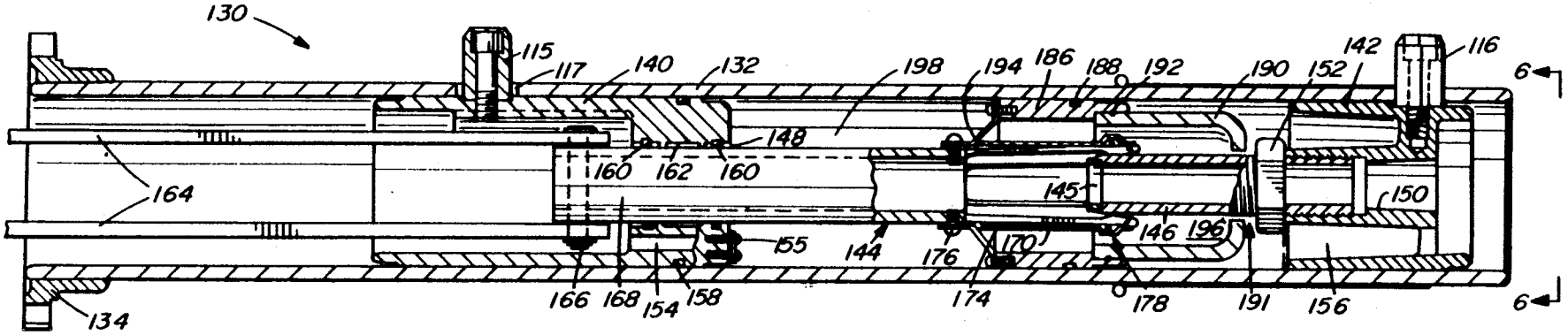
FIG. 5 shows a section view of the interrupter subassembly of the puffer interrupter shown in FIG. 3.

Referring now to FIGS. 3 and 5, subassembly 130 includes a support tube 132 which is made of an insulative material such as glass-filled epoxy, having an epoxy coating, a polyester-filled epoxy, or combination of these materials. Support tube 132 may alternatively include an inner teflon liner (not shown). Support tube 132 includes an outer flange 134 for attachment to housing flange 136 (FIG. 3) by cap screws 133 or other suitable fasteners so as to affix tube 132 in concentric alignment with housing 102.

As shown in FIG. 5, interrupter subassembly 130 further includes a lower terminal 140, upper terminal 142, moveable contact 144 and stationary contact 146. Lower and upper terminals 140, 142 are generally cylindrical components formed of a conducting material such as aluminum or copper. Contacts 144 and 146 are generally tubular in shape and form conduits for $SF_6$ gas and are also manufactured of a conducting material such as copper.

Terminals 140, 142 have outside diameters slightly less than the inside diameter of support tube 132 and are concentrically attached within tube 132 by screws (not shown). Coaxially aligned bores 148 and 150 are formed through terminals 140 and 142 respectively and serve to support contacts 144 and 146. As shown, bore 148 slidingly supports moveable contact 144 and allows reciprocal movement of contact 144 toward and away from stationary contact 146. Bore 150 in upper terminal 142 includes a threaded portion for engagement with the threaded shank end of stationary contact 146. Jam nut 152 secures stationary contact 146 within bore 150. Terminals 140 and 142 further include gas ports 154 and 156 respectively. One-way check valves 155 are affixed to lower terminal 140 to regulate gas flow through ports 154. Seals 158, 160 are disposed within annular grooves formed in lower terminal 140 and serve to prevent $SF_6$ gas from passing between support tube 132 and lower terminal 140, and between lower terminal 140 and moveable contact 144. A multilam electrical contact 162 is disposed in an annular groove within bore 148 to slidingly engage moveable contact 144, thereby creating an electrical path between moveable contact 144 and lower terminal 140.

Moveable contact 144 is reciprocated by drive links 164 by means of actuator 120 (FIGS. 3 and 4) which is connected to operator 200 by phase linkage 40 as described more fully below. Drive links 164 comprise a pair of rigid bars which are connected to moveable contact 144 by drive pin 166. When the moveable contact 144 is moved to the right as viewed in FIG. 5, the moveable and stationary contacts 144 and 146 come into contact in a coaxial manner such that a good electrical path is formed therebetween.

Figure 7:
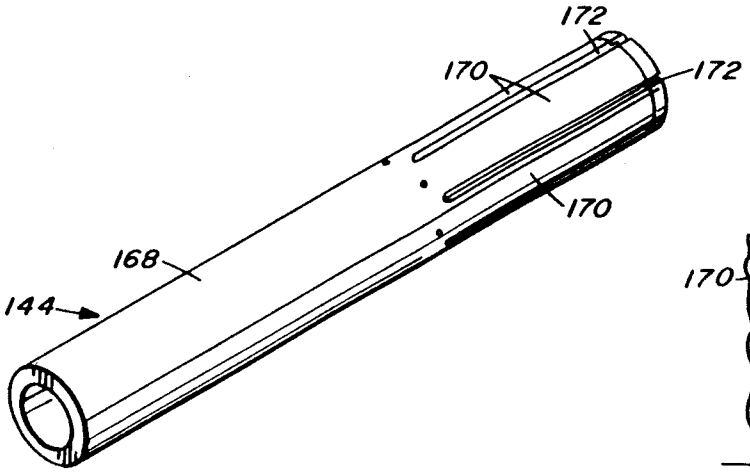
FIG. 7 shows a perspective view of the moveable contact of the interrupter subassembly shown in FIG. 5.
Figure 6:
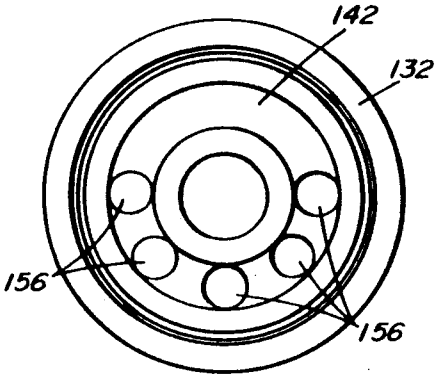
FIG. 6 shows an end view of the interrupter subassembly shown in FIG. 5.

Moveable contact 144 generally comprises a base 168, conducting fingers 170, gas shield 174 and a seal assembly 178. Base 168 includes aligned bores therethrough for receiving drive pin 166. Integrally formed upon base 168 are conducting fingers 170, shown in more detail in FIGS. 7 and 8. Referring to FIG. 7, moveable contact 144 preferably includes six conducting fingers 170 with slots 172 formed between the fingers 170. This arrangement provides lateral flexibility so that as moveable contact 144 engages stationary contact 146, fingers 170 flex in a radial direction and slide around and engage stationary contact 146. When flexed in this manner, fingers 170 maintain pressure on contact 146 so that a good electrical connection is made between moveable contact 144 and stationary contact 146. Referring again to FIGS. 5 and 8, gas shield 174 surrounds fingers 170 and prevents gas from flowing between fingers 170 through slots 172 when moveable contact 144 is engaged with stationary contact 146. Gas shield 174 is a cylindrical shaped sleeve, preferably made of copper, that is attached to base 168 below fingers 170 by fastener 176. Gas shield 174 includes circular seal channel 180 for retaining seal assembly 178.

Figure 9:
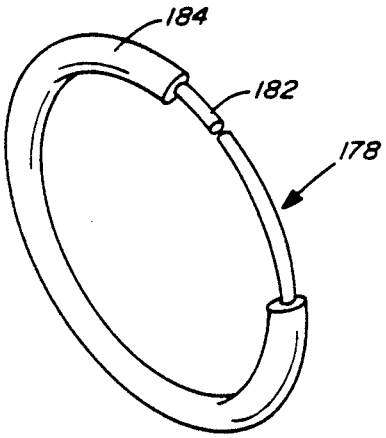
FIG. 9 shows a perspective view of the gas shield seal of the interrupter subassembly shown in FIG. 5.
Figure 9A:
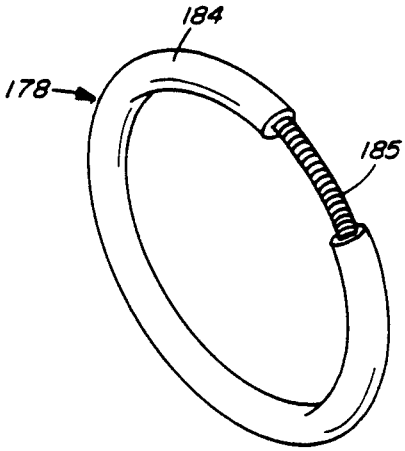
FIG. 9A shows a perspective view of an alternative embodiment of the gas shield seal shown in FIG. 9.

Referring now to FIG. 9, seal assembly 178 is comprised of a metallic C-ring spring 182 enclosed by a teflon sleeve 184. Experimentation revealed that unsleeved O-rings made of rubber or similar material deteriorated rapidly under the arcing conditions which exist during circuit opening and closing operations within puffer interrupter subassembly 130. Experimentation also revealed that while seals made of a metallic material were able to withstand the arcing conditions, such seals introduced vaporized metal particles into the arc which prolonged the arc and thus were unacceptable. The solution to this problem was to enclose the metal C-ring spring 182 inside an insulating teflon sleeve 184. The metal spring 182 provides flexibility and is able to withstand the arcing conditions, while the teflon sleeve provides insulation. FIG. 9A shows an alternative embodiment wherein a garter spring 185 is enclosed within teflon sleeve 184.

Referring again to FIG. 5, a piston 186 is slidably received within support tube 13 and attached to moveable contact 144 Piston 186 is employed to compress the $SF_6$ gas and provide the puffing action used to extinguish the arc upon circuit interruption. Piston 186 is attached to base 168 of moveable contact 144 by fasteners 176. Annular seal 188 prevents gas from flowing between support tube 132 and piston 186. Plenum 190 is attached to piston 186 by snap ring 192. In this configuration, piston 186 and plenum 190 reciprocate within support tube 132 along with moveable contact 144 and serve to define arcing chamber 196 and compression chamber 198. Arcing chamber 196 is generally defined by the interior of plenum 190. Compression chamber 198 is generally defined by the surfaces of support tube 132, moveable contact 144, lower terminal 140 and piston 186. Apertures in piston 186 form gas ports 194 which allow gas to flow between arcing chamber 196 and compression chamber 198.

Plenum 190 includes an aperture 191 sized to slidable engage stationary contact 146. Plenum 190 rides on stationary contact 146 as moveable contact 144 reciprocates within subassembly 130. No seal is included around aperture 191 of plenum 190 as, in this arrangement, manufacturing tolerances allow plenum 190 to mate with stationary contact 146 in such a manner that the flow of gas between plenum 190 and stationary contact 146 is negligible.

Figure 8:
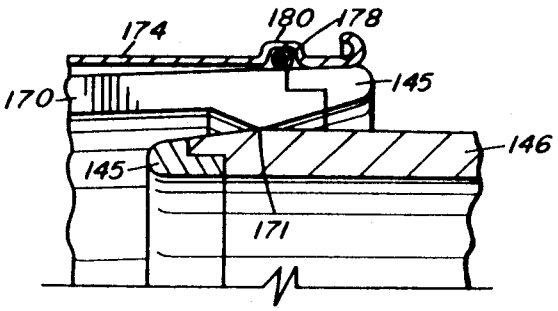
FIG. 8 shows a section view of a portion of the moveable contact shown in FIG. 7 when the contact is in closed position.

Referring now to FIGS. 5 and 8, stationary contact 146 and moveable contact 144 both include arcing tips 145 formed on the terminus portion of the contacts. Arcing tips 145 do not carry continuous currents, but are employed only during circuit opening and closing operations when an arc is formed. Arcing tips 145 are made of a copper-tungsten material that does not readily erode or ablate during arcing. As shown best in FIG. 8, fingers 170 also include electrical connections 171 which comprise raised areas on fingers 170 designed to provide good electrical contact between fingers 170 and stationary contact 146 and to carry the continuous flow of current through interrupter subassembly 130. Fingers 170 are flexible, and the diameter of the circular contact surface formed by current carrying electrical connections 171 is less than the outside diameter of stationary contact 146. Therefore, as moveable contact 144 is moved to the right and into engagement with stationary contact 146 as shown in FIG. 5, fingers 170 are forced outward by the cam action of wedge-shaped electrical connections 171 and are held in contact with stationary contact 146 by the spring action of fingers 170.

Current flowing through contacts 144, 146 is also conducted through lower and upper terminals 140, 142 and bushings 30, 31. The electrical connection between bushinqs 30, 31 and terminals 140, 142 is provided by metallic contact studs 115, 116. Best shown in FIGS. 3 and 5, studs 115, 116 are disposed through apertures 117 in support tube 132 and make electrical contact with terminals 140, 142 respectively. Studs 115, 116 include a threaded bore coaxially aligned with a corresponding threaded bore in terminals 140, 142. A recessed cap screw secures studs 115, 116 to terminals 140, 142. Conductor 26 within bushings 30, 31 is connected to studs 115, 116 by connector 25 or other suitable electrical connection means.

Operation of Interrupter 100

Figure 10A:
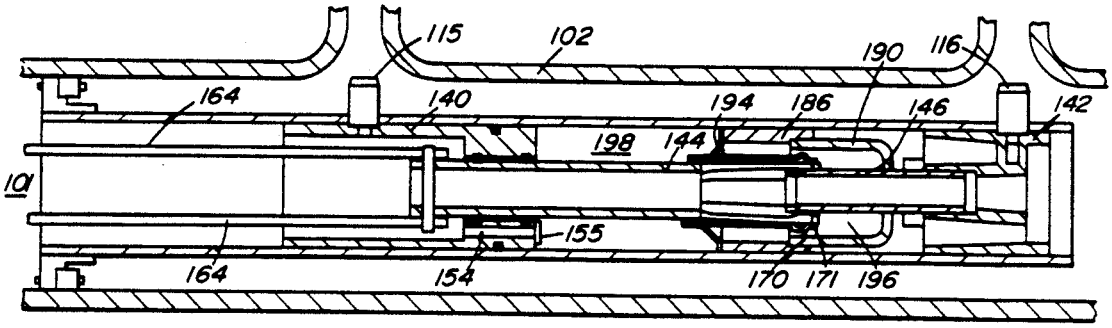
FIGS. 10A–10D diagrammatically show the opening and closing sequence of the interrupter shown in FIG. 3.

The operation of puffer interrupters 100 to open and close a circuit will now be described with reference to FIGS. 10A–D. Referring first to FIG. 10A, the puffer interrupter 100 is shown with contacts 144, 146 in the closed or current carrying position. Current flows through interrupter 100 by means of the conducting path formed by lower terminal 140, moveable contact 144, stationary contact 146, upper terminal 142 and contact studs 115, 116. To interrupt the current flowing through this path, drive link 164 moves to the left, thereby drawing moveable contact 144 away from and out of engagement with stationary contact 146. As moveable contact 144 moves to the left, it also draws piston 186 to the left. Check valves 155 are closed to gas flowing from right to left through gas ports 154, thus the $SF_6$ gas in compression chamber 198 is trapped and compressed by piston 186. Because of the precise fit between the stationary contact 146 and plenum 190, and in view of the close fit between stationary contact 146 and electrical connections 171, arcing chamber 196 is relatively gas-tight. Gas ports 194 in piston 186 form a conduit for gas to flow between arcing chamber 196 and compression chamber 198. As piston 186 is moved to the left, the volume of arcing chamber 196 remains relatively constant; however, the volume of compression chamber 198 decreases, thereby increasing the gas pressure within chambers 196, 198.

Figure 10B:
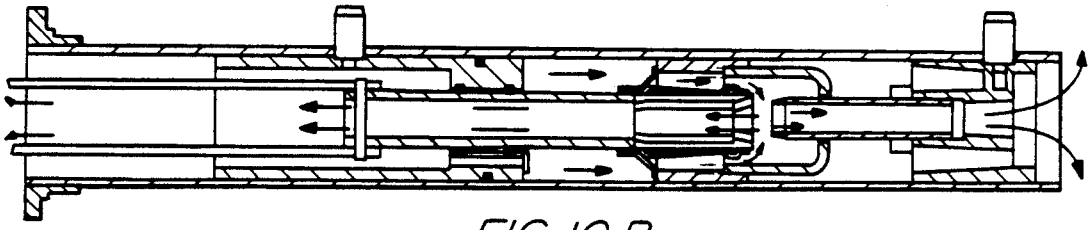

As fingers 170, best shown in FIG. 5, continue to be drawn to the left, electrical connections 171 slide out of engagement with stationary contact 146. Arcing tips 145 of stationary and moveable contacts 146 and 144 thereafter come into contact and then begin to separate. FIG. 10B depicts contacts 144, 146 after partial separation. As the contacts 144, 146 separate, an arc is formed between arcing tips 145 which generates heat and further increases the pressure of the gas in the arcing chamber 196 and compression chamber 198. During arcing, the arc may fill up the entire plenum 190. The formation and presence of the arc acts as a plug for preventing gas from flowing from arcing chamber 196 into dielectric chamber 101 through the hollow interior of contacts 144, 146

The current flowing across the gap formed by separating arcing tips 145 is alternating current and thus sinusoidal in nature. As a current flow reaches zero, the arc disappears. Without the arc acting as a plug and preventing gas flow, gas is now allowed to flow into contact dielectric chamber 101 through stationary contact 146 and moveable contact 144 as shown in FIG. 10B. The flow of the pressurized $SF_6$ gas normally prevents the arc from reestablishing itself after the first current zero.

If the arc reestablishes itself on the next half cycle, it again acts as a plug to stop and prevent the flow of gas. The arc again heats the gas in the arcing chamber 196 and further increases the gas pressure. Thus, when the next current zero is reached, high pressure gas again flows from the compression chamber 198 into arcing chamber 196, and into dielectric chamber 101 through the interior of stationary contact 146 and moveable contact 144.

Figure 10C:
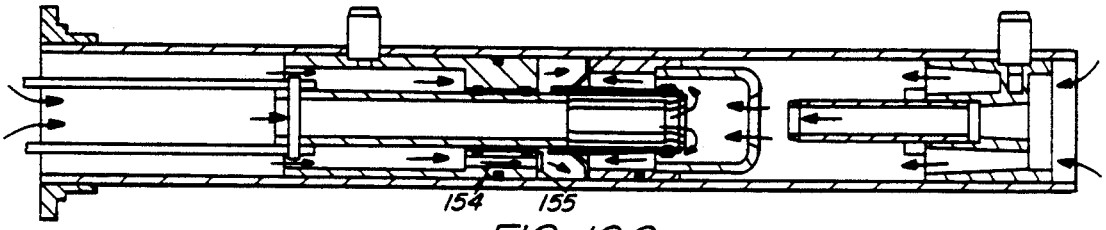

After interruption of the arc, fingers 170 have been moved completely to the left and plenum 190 has completely disengaged from stationary contact 146 as shown in FIG. 10C. At this point, the gas pressure has equalized throughout dielectric chamber 101, compression chamber 198 and arcing chamber 196.

Figure 10D:
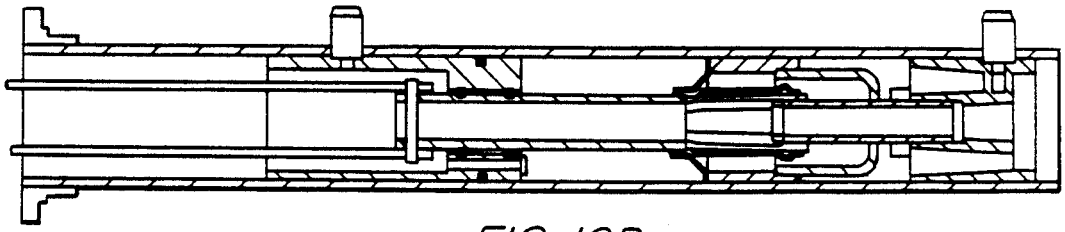

During the circuit closing cycle, moveable contact 144, piston 186 and plenum 190 are moved to the right from their initial positions shown in FIG. 10C. As contact 144 is moved toward contact 146, plenum 190 again engages and rides upon stationary contact 146, thereby closing off the arcing chamber 196 and compression chamber 198 from dielectric chamber 101. At this point, valves 155 on the lower terminal 140 opens, allowing gas to flow through port 154 and allowing compression chamber 198 to maintain equilibrium with the dielectric chamber 101 so as to prevent a vacuum which would otherwise be drawn as piston 186 moves to the right. At some point of travel of the moveable contact 144, an arc again forms between the arcing tips 145 of contacts 144 and 146 within plenum 190. As moveable contact 144 continues to move to the right, the arcing tips 145 of the contacts come into physical contact. Thereafter fingers 170 are flexed outward by the cam action of the electrical connections 171 upon stationary contact 146. As shown in FIG. 10D, electrical connections 171 are eventually pushed up and over stationary contact 146 and form the current carrying contacts between moveable contacts 144 and stationary contact 146. In this manner, arcing tips 145 are not called upon to carry continuous currents. Likewise, with the arc forming between arcing tips 145 upon both separation and engagement of moveable contact 144 and stationary contact 146, electrical connections 171, the contacts serving to carry the continuous current load, are not subjected to the extreme conditions generated by the arc.

Interrupters 100 of the present invention are further described in U.S. Pat. application Ser. No. 117,604, filed Nov. 6, 1987, incorporated herein by reference.

Actuator 120

Figure 4:
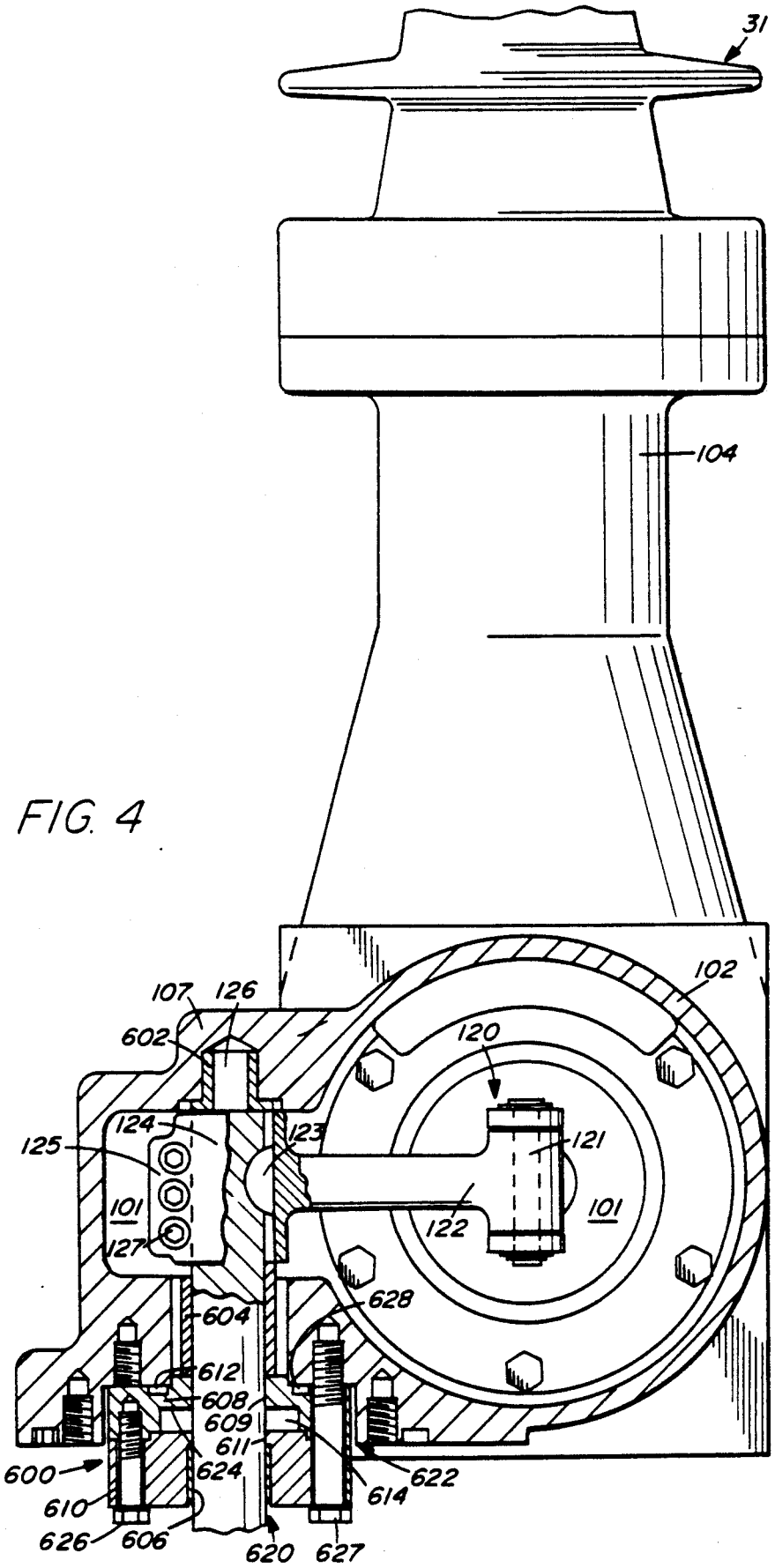
FIG. 4 shows an end view, partly in cross section, of the seal assembly and actuator of the puffer interrupter shown in FIG. 3.

Referring now to FIGS. 3 and 4, there is shown actuator 120. Actuator 120, in cooperation with drive links 164 (shown in FIG. 3), phase linkage 40 (shown in FIG. 12) and operator 200, causes contacts 144, 146 to open and close by reciprocating moveable contact 144 within interrupter subassembly 130 in response to the operation of operator 200. Actuator 120 includes a rotary seal assembly 600 to prevent the $SF_6$ gas or other dielectric media contained in dielectric chamber 101 from escaping at the location where actuator 120 extends into housing 102.

Referring now to FIG. 4, actuator 120 generally comprises a lever arm 122 and a rotatable actuator shaft 126. Pin 121 rotatably secures one end of lever arm 122 to drive link 164. Integrally formed on the opposite end of lever arm 122 is a collar 124 connected to the upper end of actuator shaft 126. Collar 124 includes inwardly extending shaft key 123 and a pair of opposing flanges 125. Actuator shaft 126 includes a key slot (not shown) which engages key 123 when collar 124 is positioned about shaft 126. Cap screws 127 engage threaded bores formed through flanges 125 and serve to draw opposing flanges 125 towards each other when tightened. Key 123 and cap screws 127 thus cooperate to secure collar 124 in position about actuator shaft 126.

As best shown in FIG. 4, interrupter housing 102 includes a housing extension 107 for enclosing actuator shaft 126. Housing extension 107 is a lateral extension of cylindrical body 103 and forms a portion of dielectric chamber 101 for retaining the $SF_6$ gas or other dielectric media. Housing extension 107 includes a bore 620 formed generally perpendicularly to, but offset from, the longitudinal axis of interrupter 100. Actuator shaft 126 is retained within bore 620 by a flanged bearing 602, an insulated sleeve bushing 604 and a sleeve bearing 606. Each of bearings 602, 606 and bushing 604 is manufactured from or coated with teflon or other suitable non-metallic bearing material.

Referring still to FIG. 4, sealing of the dielectric media within dielectric chamber 101 is accomplished by means of rotary seal assembly 600. Rotary seal assembly 600 generally comprises seal housing module 608, bearing housing module 610, static O-ring seal 612 and rotary seal 614.

As shown in FIG. 4, seal housing module 608 and bearing housing module 610 are formed of generally cylindrical metallic blocks having bores 609 and 611, respectively, coaxially aligned with bore 620 in housing extension 107. Housing extension 107 includes a recess or seat 622 for attaching seal assembly 600 to interrupter housing 102. Seat 622 is generally circular in shape and has a diameter slightly greater than the diameter of housing modules 608, 610. Rotary seal 614 is disposed about actuator shaft 126 in lower groove 624 formed in seal housing module 608. Cap screws 626 secure rotary seal 614 between seal housing module 608 and bearing housing module 610. Static O-ring seal 612 is disposed about actuator shaft 126 in an upper groove 628 formed within seal housing module 608. The assembled rotary seal assembly 600 is secured to housing extension 107 within recess 622 by cap screws 627.

In this arrangement, static O-ring seal 612 and rotary seal 614 prevent the $SF_6$ gas from escaping dielectric chamber 101 through the penetration of interrupter housing 102 that is required for actuator shaft 126. Importantly, rotary seal assembly 600 includes no moving metal-to-metal components which could generate damaging metal filings or chips. Further, seal assembly 600 requires no lubrication which could introduce or cause foreign matter to collect on the bearings, shaft or seals. This unique modular seal assembly allows for the interchangeability of seal assembly components between interrupters, facilities repairs, eliminates the need for fine machining of the interrupter housing during manufacture or repair, and is also capable of temperature cycling from −40° C. to +70° C.

Phase Linkage 40

Figure 12:
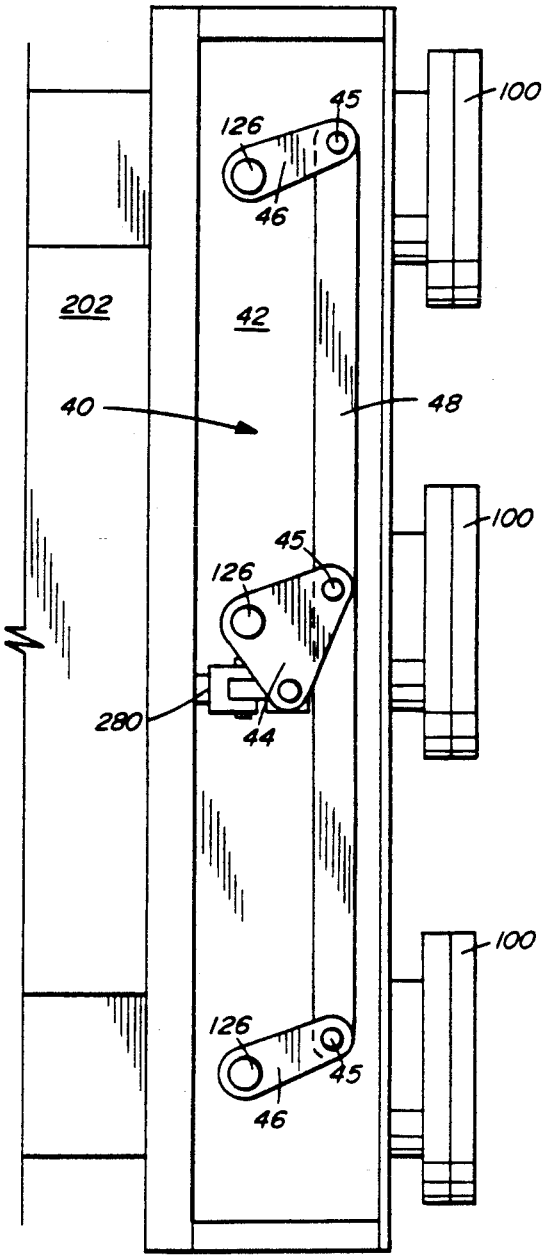
FIG. 12 shows a bottom view of the phase linkage which connects the spring stored energy operator of FIG. 13 with the puffer interrupter of FIG. 3.
Figure 13:
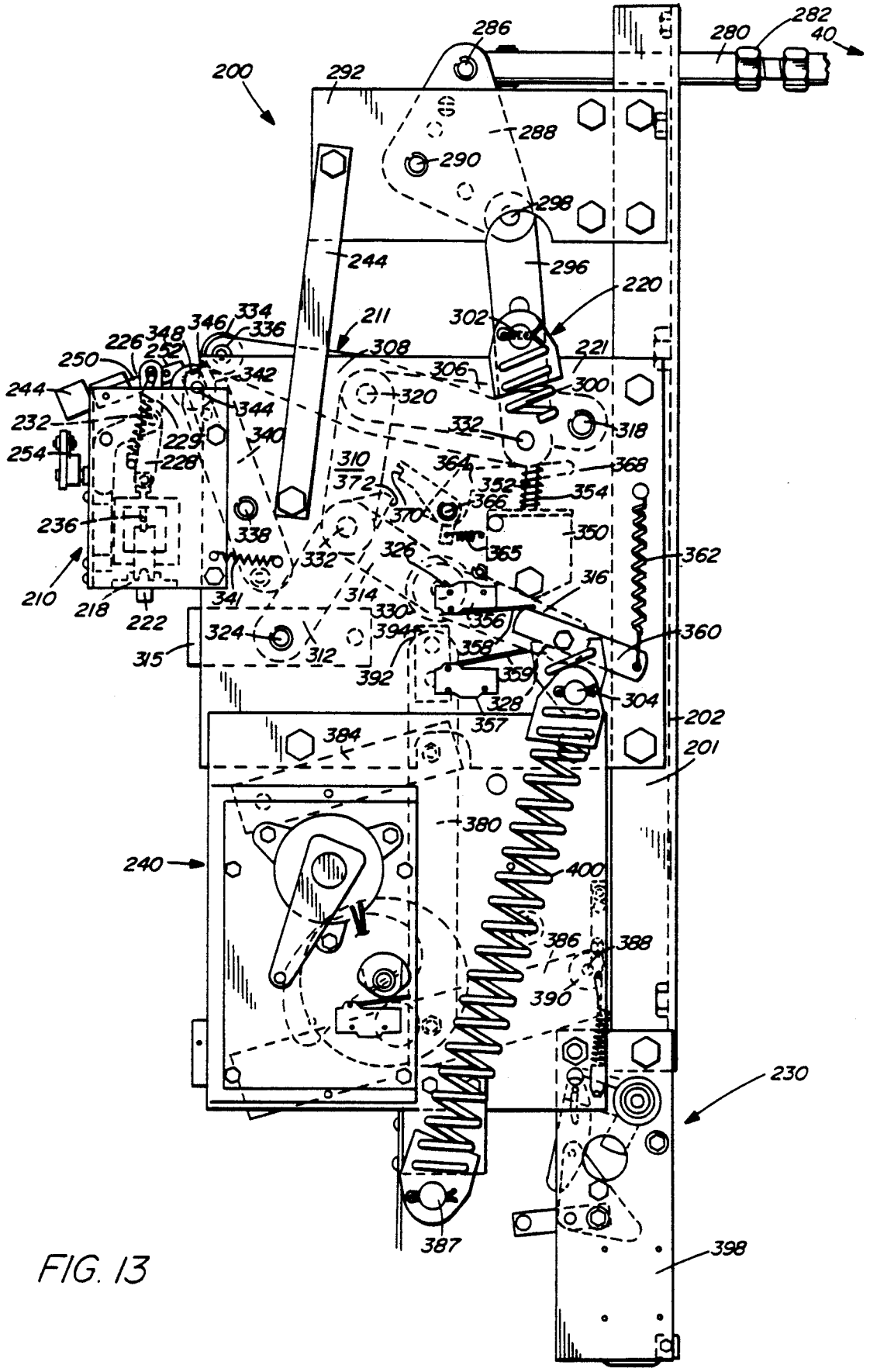
FIG. 13 shows a side elevation view of the spring stored energy operator in the open position with the opening and closing springs discharged.

Referring now generally to FIGS. 4 and 13, and particularly to FIG. 12, there is generally depicted the phase linkage 40 housed within easily accessible linkage enclosure 42. Phase linkage 40 translates the reciprocal motion of drive bar 280 of operator 200 into rotational motion of actuator shafts 126 to reciprocate drive links 164 by means of lever 122, to open and close the contacts 144, 146 in each interrupter 100. Operator 200 and phase linkage 40 are housed in connecting separate enclosures 202, 42, respectively. As shown in FIG. 12, phase linkage 40 generally comprises master lever arm 44, a pair of follower arms 46 and connector link 48. One end of each arm 44 and 46 is rigidly attached to the adjacent actuator shaft !26 of each interrupter 100. The opposite end o arms 44 and 46 are each pivotably secured to connector link 48 by pins 45 and locking fasteners (not shown). Drive bar 280 extends from operator 200 through enclosure 202 and into enclosure 42 where it is pivotably attached to master lever 44 by pin 45 and locking fasteners (not shown). With this arrangement, the reciprocation of drive bar 280 will pivot master lever arm 44 and rotate actuator shafts 126 and lever arms 122 in each of the interrupters 100, thereby simultaneously opening or closing each phase of the three-phase circuit.

Operator 200

Figure 14:
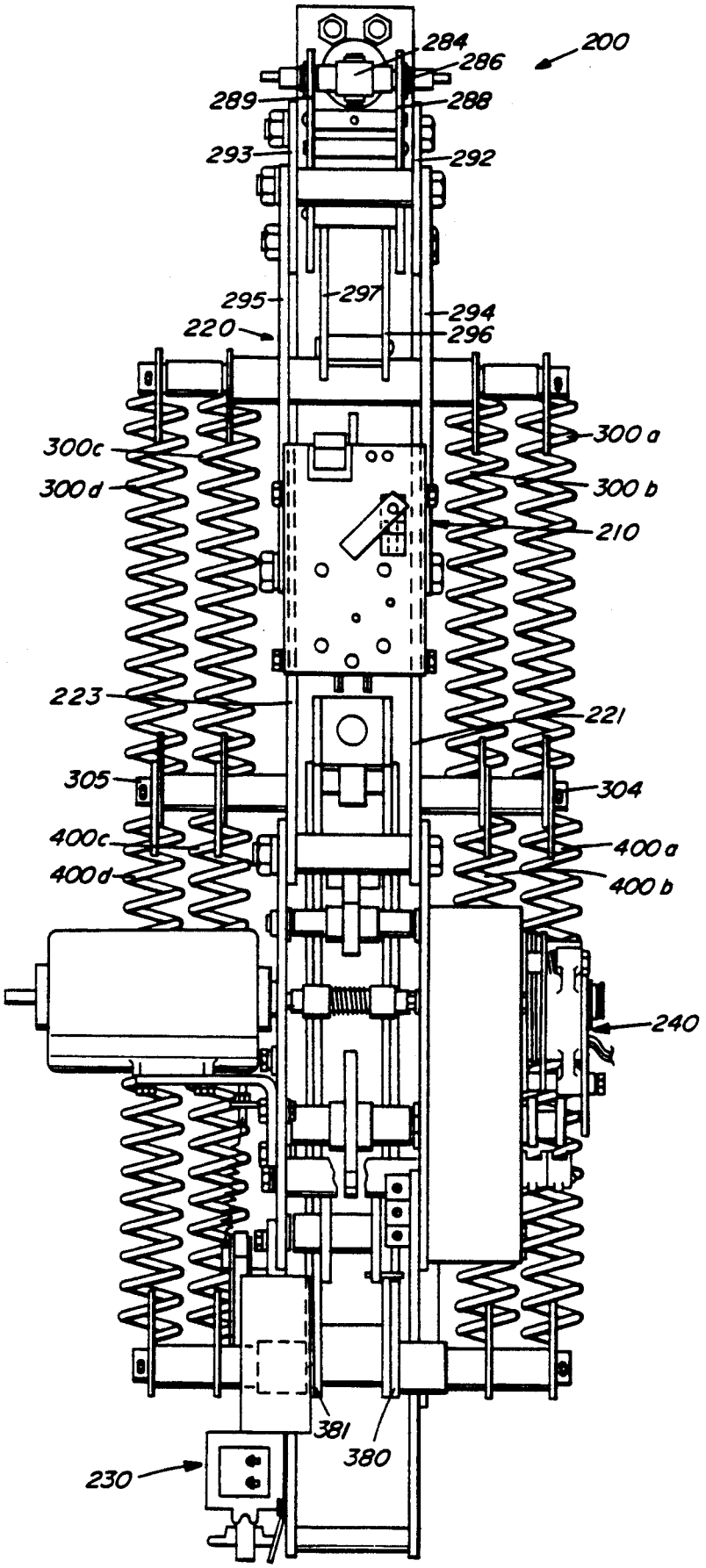
FIG. 14 shows a front view of the operator of FIG. 13.

Referring now to FIGS. 13 and 14, there are shown side and front elevation views of the operator 200. As previously described, operator 200, upon receipt of a "trip" signal from controller 14, will actuate each of the puffer interrupters 100 by reciprocating drive links 164 causing moveable contacts 144 to reciprocate within interrupter subassembly 130 to open and close contacts 144, 146. Operator 200 can operate at high speeds so as to perform such open and close sequences in quick succession in response to the existence of a fault or system disturbance detected by controller 14 or relays 16.

Operator 200 uses spring stored energy for actuation and may be controlled with conventional low energy electronic or relay controls so as to complete and open-close sequence in less than two seconds.

The operator 200 is supported and housed within enclosure 202 mounted on frame 201. Operator 200 includes an open actuator 210, an opening mechanism 220, a close actuator 230, and a closing mechanism 240. The open actuator 210 receives the "trip open" signal from the controller 14 to actuate the opening mechanism 220. The opening mechanism 220 is a spring stored energy mechanism which, when activated by open actuator 210, reciprocates the phase linkage 40 and drive links 164 to open the interrupter contacts 144, 146. Close actuator 230, in response to a "trip closed" signal from controller 14, actuates the closing mechanism 240 which reciprocates the phase linkage 40 and drive links 164 to close the interrupter contacts 144, 146. The open and close actuators 210, 230 can operate opening and closing mechanisms 220, 240 in rapid succession such that the open-close sequence can be accomplished in less than two seconds. Although open and close actuators 210, 230 have been described as being triggered by a "trip" signal, the open and close actuators 210, 230 may also be operated manually. As will be described in further detail below, operator 200 has three operational modes, i.e., electrical operation, fast manual operation, and slow manual operation. The slow manual operation of operator 200 is required to allow for maintenance, inspection, and servicing of the $SF_6$ puffer recloser 10.

Open Actuator 210

Figure 15:
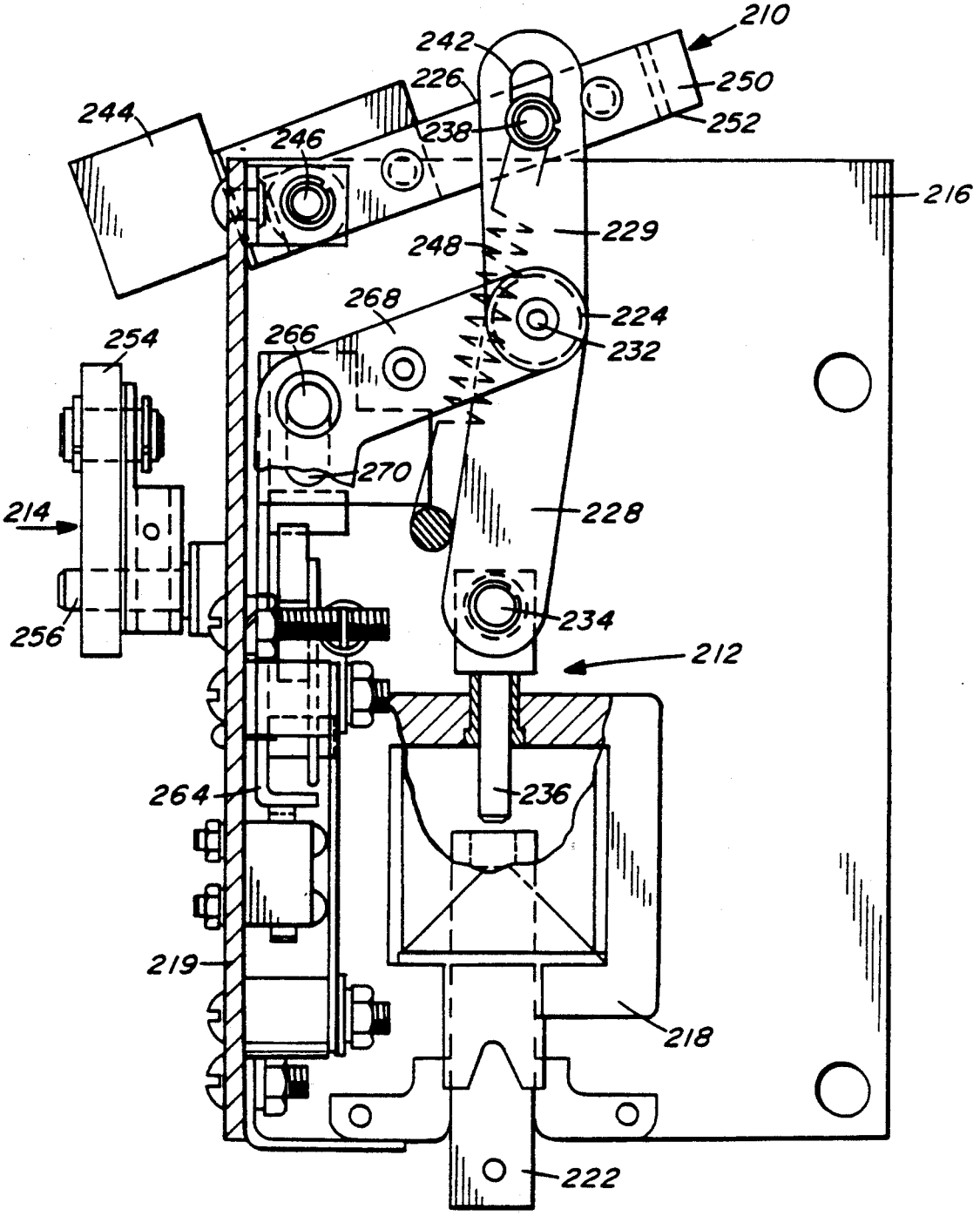
FIG. 15 shows a side elevation view, partly in cross section, of the open actuator of the operator of FIG. 13.
Figure 16:
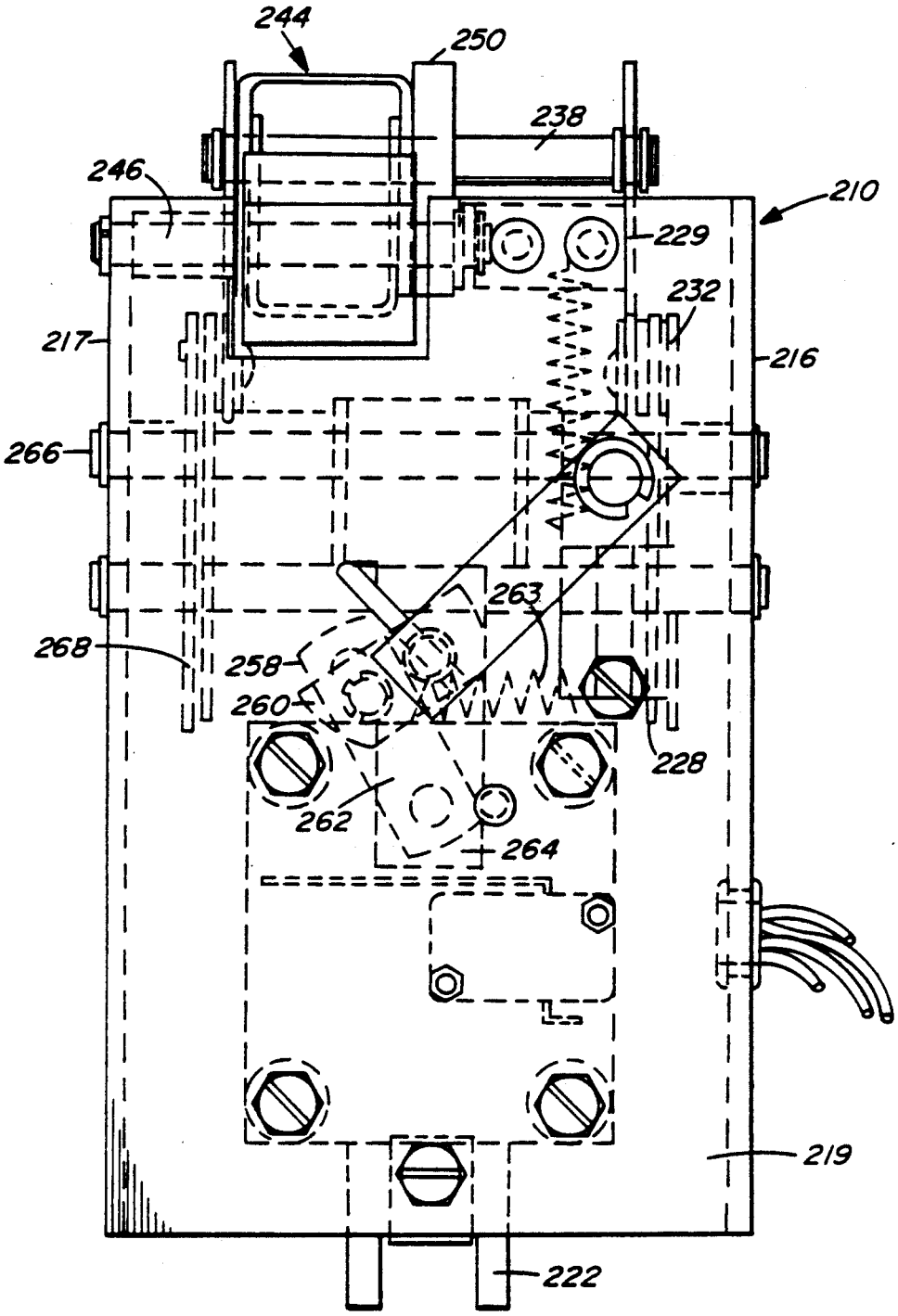
FIG. 16 shows a front view of the open actuator of FIG. 15.

For a detailed description of open actuator 210, reference will now be made to FIGS. 15 and 16 in conjunction with FIGS. 13 and 14. Referring particularly to FIG. 15, open actuator 210 includes a solenoid trip assembly 212 and a manual trip assembly 214. As best shown in FIGS. 14 and 16, open actuator 210 includes two parallel rectangular plates 216, 217 mounted on two parallel rectangular support plates 221, 223 of opening mechanism 220. As shown in FIGS. 15 and 16, solenoid trip assembly 212 includes a trip open solenoid 218 which includes a plunger 222 that engages a toggle link assembly 224. Assembly 224 is connected to a bracket and latch assembly 226 that releases the opening mechanism 220 for opening the electrical contacts 144, 146 in interrupters 100. Toggle link assembly 224 includes parallel pairs of toggle links 228, 229 rotationally mounted together by bolted connection 231, 232. A pin 234 extends between the opposite ends of toggle links 228 which also has connected therebetween a piston 236 adapted for engagement with the plunger 222 of trip solenoid 218. The other ends of the pair of toggle links 229 include a pin 238 extending therebetween and disposed in an oblong aperture 242 in each end of toggle links 229 thereby permitting a limited reciprocal motion of pin 238 within aperture 242. Pin 238 is also in connection with bracket and latch assembly 226.

Bracket and latch assembly 226 includes a bracket 244 mounted on one end of a latch member 250 which engages opening mechanism 220. Latch member 250 has a first aperture through which pin 238 passes and a second aperture through which a pin 246 passes and on which bracket 244 is also mounted. The free end 252 of latch member 250 engages trip latch 340 (FIG. 13) of opening mechanism 220 as is described in more detail below. Bracket 244 is weighted so as to balance latch member 250 about pin 246. A spring 248 extends from the pin 238 to a mount on the side of plate 216 to bias pin 238 downwardly in oblong aperture 242.

Upon actuation of trip open solenoid 218, plunger 222 engages pin 236 to move toggle link assembly linkage 224 in the upward vertical direction so as to also move end 252 of latch 250 out of engagement with the trip latch 340 of opening mechanism 220 so as to allow opening mechanism 220 to become unlatched and open interrupter contacts 144, 146 as described below.

Open actuator 210 also includes a manual trip assembly 214. Manual trip assembly 2!4 includes a manual pull link 254 mounted on pin 256 projecting from the end plate 219 which is mounted between plates 216, 217 of open actuator 210. Manual trip assembly 214 includes a linkage train 258 which, upon manual operation of pull link 254, causes the pair of toggle links 229 and pin 238 to move upwardly and thus release latch 250. Linkage train 258 includes links 260, 262 and a spring 263 which reciprocate a pair of links 264 having a pin 266 extending through one end and having mounted thereon another set of parallel links 268 having a general L-shape. L-shaped links 268 include an oblong aperture 270 to permit a limited reciprocation of the ends of pin 266 within aperture 270. L-shaped links 268 have one end connected to the bolts 231, 232 which also connects the ends of toggle links 228, 229. Thus, upon the manual rotation of pull link 254, the link train 258 causes L-shaped link 268 to move vertically upward and, due to the connection with the pair of toggle links 229 by bolts 231, 232, also causes toggle links 229 to move upward, thus bringing pin 238 to bear against latch assembly 250 causing latch assembly 250 to release opening mechanism 220.

Opening Mechanism 220

Referring again to FIGS. 13 and 14, and particularly to FIG. 13, the opening mechanism 220 includes drive bar 280 connected to phase linkage 40 by union 282. That end of drive bar 280 opposite union 282 includes a clevis 284 shown in FIG. 14 through which extends a pin 286. The ends of pin 286 also pass through aligned apertures in a pair of parallel triangular shaped links 288, 289. Triangular links 288, 289 are pivotally mounted by pin 290 on parallel support plates 292, 293 which are supported by the frame 201 of operator enclosure 202. Parallel support plates 292, 293 are further supported by support members 294, 295 extending from the support plates 221, 223.

Best shown in FIG. 13, a pair of parallel open/close links 296, 297 are connected by pin 298 to the third corner of triangular links 288, 289. The vertical movement of open/close links 296, 297 causes triangular links 288, 289 to pivot about pin 290 so as to reciprocate drive bar 280 and the attached phase linkage 40.

Opening mechanism 220 includes a plurality of opening springs 300, each having one end affixed to a shaft 302 passing through aligned apertures in the pair of parallel open/close links 296, 297. In the preferred embodiment, there are four opening springs 300, two springs located on each side of open/close links 296, 297. The opposite ends of springs 300 are attached to coaxially aligned shafts 304, 305 which project perpendicularly from each of the support plates 221, 223. As viewed in FIG. 13, opening springs 300 provide the force required to rotate triangular links 288, 289 clockwise and thereby reciprocate drive bar 280 in the direction of the arrow to cause phase linkage 40 and drive links 164 to open interrupter contacts 144, 146. As shown in FIGS. 13 and 14, triangular links 288, 289 are shown in the position they maintain when interrupter contacts 144, 146 are open, and opening springs 300 are shown in the discharged or compressed state.

Opening mechanism 22 further includes linkage 211 for engagement with the open actuator 210 which, once the opening springs 300 are charged, latches the open/close links 296, 297 in the upward and closed position until the open actuator 210 releases the linkage 211 to permit the charged opening springs 300, then in tension, to release their stored energy and thereby pull apart engaged interrupter contacts 144, 146. This linkage 21 also is in engagement with the closing mechanism 240 for closing interrupter contacts 144, 146 upon actuation by close actuator 230 as hereinafter further described.

The linkage 211 of opening mechanism 220 includes six links or link pairs, namely: first end link pair 306, balance beam link 308, first medial link pair 310, side link 312, second medial link pair 314, and second end link 316. First end link pair 306 has one end pivotally mounted to the support plate 221 by pin 318 The other end of first end link pair 306 is rotatably connected by pin 320 to one end of first medial link pair 310 and to balance beam link 308 by passing through an aperture at the midpoint of balance beam link 308. The other end of first medial link pair 310 is rotatably connected by pin 322 to one end of second medial link pair 314 and to one end of side link 312. The other end of side link 312 is affixed to a link 315 by pin 324. Links 31 and 315 are rotatably mounted to support plate 221 by pin 324. The other end of second medial link pair 314 is rotatably mounted on one end of second end link 316 by a pin 326. Also mounted on pin 326 is a roller 330 adapted for engagement with the closing mechanism 240 as is hereinafter described in further detail. The other end of second end link 316 is rotatably affixed to the support plate 221 by pin 328. The fixed points of rotation at pins 318, 324, and 328 cause the balance beam link 308 connection at pin 320 to move in the generally upward vertical direction as the closing mechanism 240 bears against roller 330 in a generally upward vertical direction.

The balance beam link 308 is rotatably mounted at one end to the lower ends of open/close links 296, 297 by a pin 332. On the opposite end of balance beam link 308 is rotatably mounted a roller 334 on a pin 336. Pin 320 of balance beam link 308 acts as a fulcrum whereby a downward lever force may be applied to pin 332 causing pin 332 to place a downward vertical force on open/close links 296, 297 thereby rotating triangular links 288, 289 clockwise about at pin 290.

Figure 21:
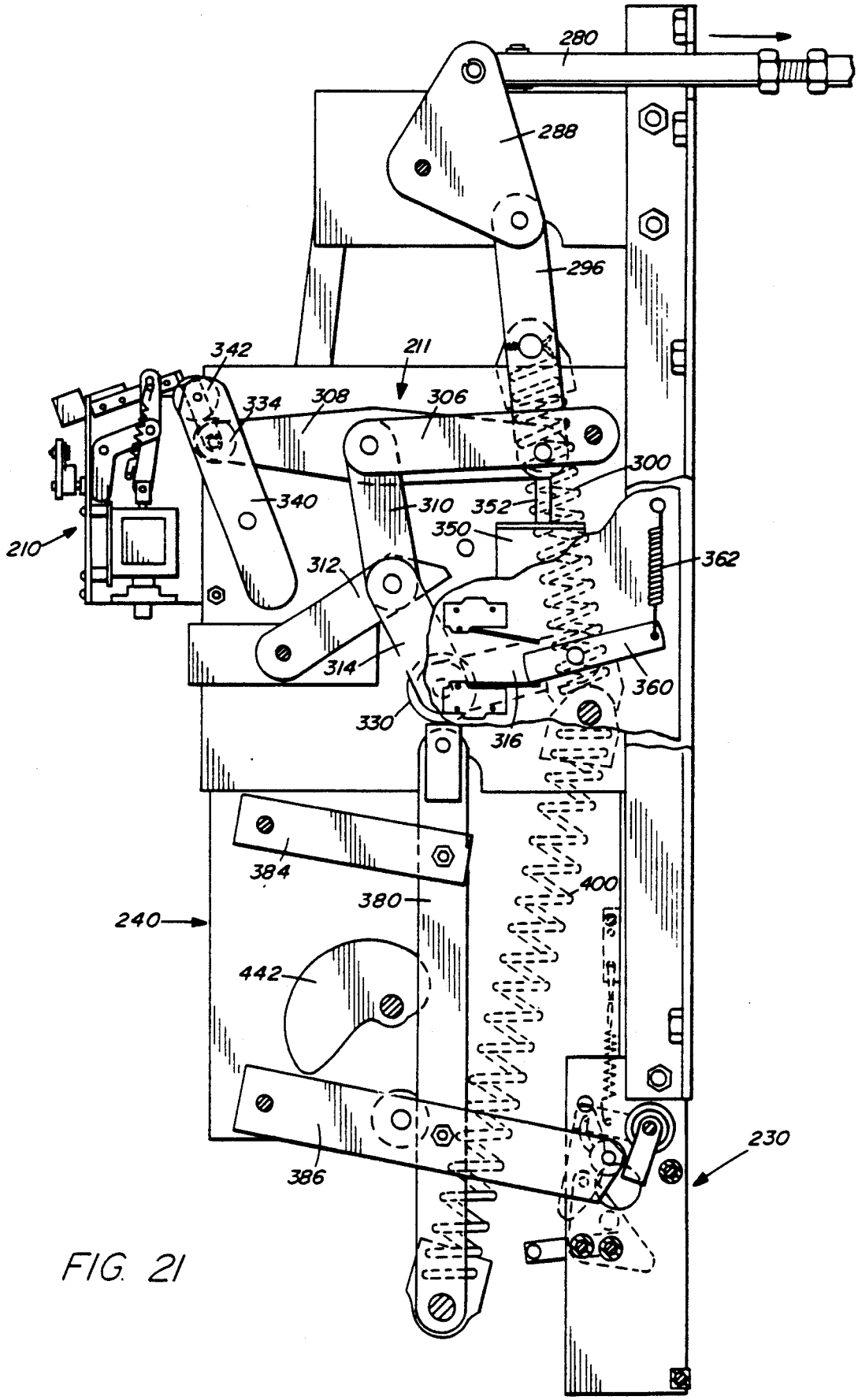
FIG. 21 shows the operator of FIG. 13 in the open position with the closing springs charged and the opening springs discharged.
Figure 22:
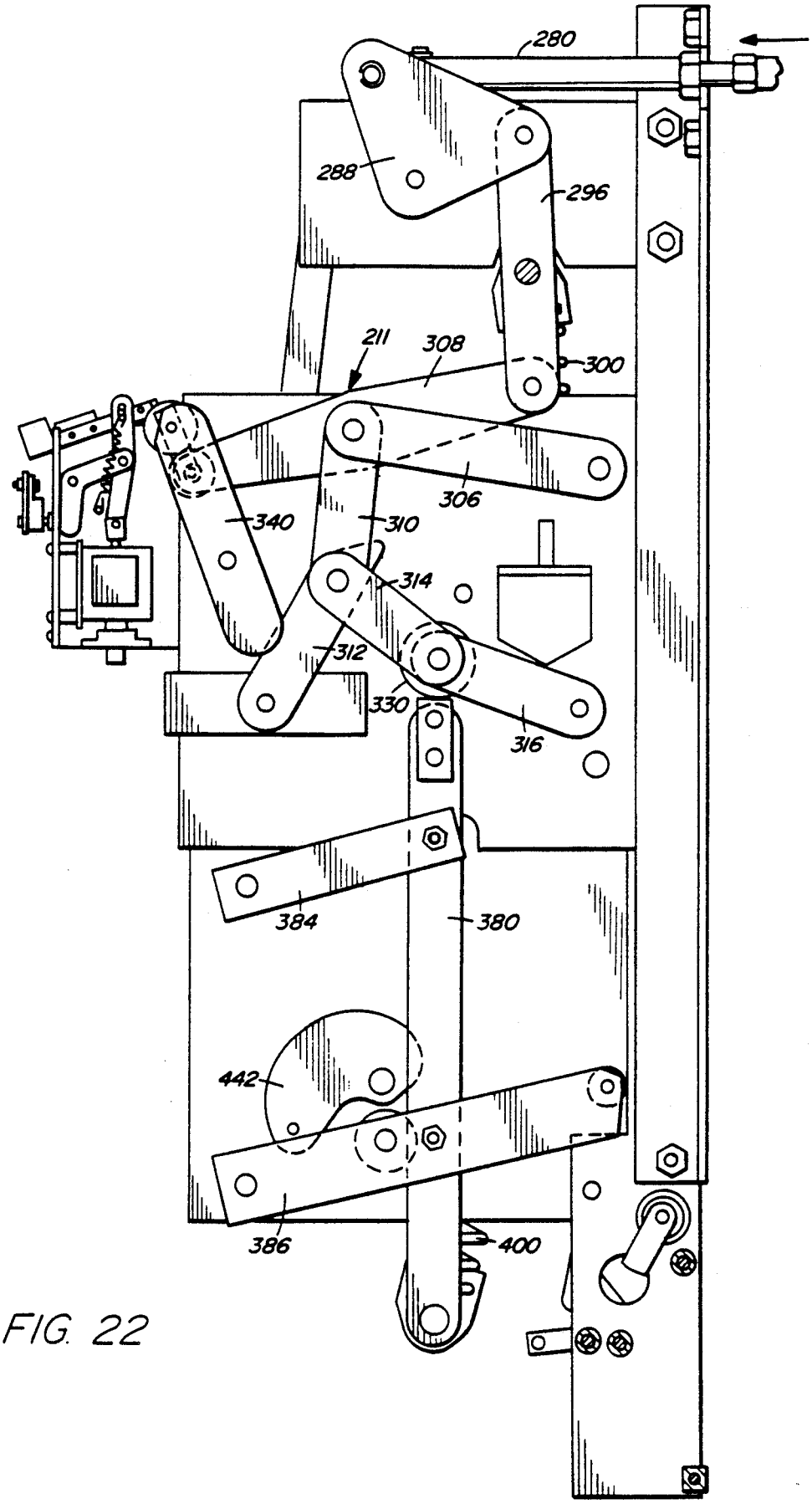
FIG. 22 shows the operator of FIG. 13 in the closed position with the closing springs discharged and the opening springs charged.

A trip latch 340 is rotatably mounted on pin 338 adjacent open actuator 210. Trip latch 340 has rotatably mounted on one end a roller 342 rotatably mounted on a pin 344. A spring 341 is attached to the opposite end of trip latch 340 and to support plate 221 so as to bias trip latch 340 to rotate about pin 338 in the clockwise direction. In actuating the operator 200 to both open and close interrupter contacts 144, 146, the trip latch 340 is positioned such that roller 342 rotatably engages roller 334 of balance beam link 308 from above as shown in FIGS. 21 and 22. A latch engagement member 346, best shown in FIG. 13, is mounted on trip latch 340 adjacent roller 342 and is adapted for engagement with the end 252 of latch 250 on open actuator 210 to maintain roller 334 beneath roller 342 of trip latch 340 as shown in FIGS. 21 and 22. Latch engagement member 346 includes an engagement end 348 having a face perpendicular to the axis of trip latch 340 so as to engage end 252 of latch 250. As is best shown in FIGS. 21 and 22, upon the mating engagement of ends 252 and 348, roller 342 of trip latch 340 locks roller 334 of balance beam link 308 in position whereby upon the reciprocal movement of balance beam link 308, roller 334 bears against roller 342 causing the other end of balance beam link 308 to reciprocate, thereby rotating triangular links 288, 289. In the closing operation, pin 320 is moved upwardly from its position shown in FIG. 21, causing triangular links 288, 289 to rotate in the counter-clockwise direction so as to reciprocate drive bar 280 in the direction opposite the arrow shown in FIG. 21 and thereby actuate phase linkage 40 and drive links 164 to close interrupter contacts 144, 146.

To open interrupter contacts 144, 146, opening springs 300 are charged and open actuator 210 may be electrically or manually actuated as previously described so as to release the engagement of surfaces 252, 348 of latch 250 and trip latch 340. Trip latch 340 rotates counter-clockwise about pin 338 permitting that end of balance beam link 308 with roller 334 to roll upwardly past roller 342 permitting balance beam link 308 to pivot on pin 320. This allows opening springs 300 to snap downwardly pulling open/close links 296, 297 also downwardly. This movement causes triangular links 288, 289 to rotate in the clockwise direction about pin 290 to move drive bar 280 in the direction of the arrow shown in FIG. 21, thus actuating phase linkage 40, actuators 120 and drive links 164 to open interrupter contacts 144, 146.

Referring again to FIG. 13, opening mechanism 220 also includes a dash pot assembly 350 having a plunger 352 which engages pin 332 which connects the lower ends of open/close links 296, 297. A spring 354 maintains plunger 352 in the extended position. Upon actuation of operator 200, the dash pot assembly 350 dampens the reciprocation and vibration of open/close links 296, 297.

Still referring to FIG. 13, opening mechanism 220 further includes microswitches 356, 357 and lever arm 360. Microswitches have trip arms 358, 359 for actuation by one end of lever arm 360. Lever arm 360 is rotatably mounted on support member 221 by pin 328 together with one end of second end link 316. A spring 362 has one end attached to that end of lever arm 360 opposite microswitches 356, 357 and the other end attached to the support plate 221 so as to bias lever arm 360 and attached second end link 316 counter-clockwise. As second end link 316 rotates with the linkage 211 of opening mechanism 220, arms 358, 359 of the microswitches 356, 357 are tripped by lever arm 360 providing indication of the position of opening mechanism 220.

A prop latch 364 is rotatably mounted on the support plate 221 by pin 366. Prop latch 364 is formed of three pieces, one having a camming surface 368 in engagement with pin 332 which passes through the lower end of open/close links 296, 297, a second piece having a notched surface 370 in its end adapted for engagement with a corresponding notched surface 372 on that end of side link 312 joined by pin 322, and a third piece attached to spring 365 which is also attached to support plate 221 and tends to rotate prop latch 364 counter-clockwise into engagement With notched surface 372 of side link 312. Prop latch 364 is used to maintain the operator 200 in the closed position with opening springs 300 charged until actuation of the trip open actuator 210. Upon the engagement of surfaces 370 and 372, prop latch 364 prevents side link 312 from rotating clockwise which would permit opening springs 300 to discharge by allowing linkage 211 of opening mechanism 220 to move downwardly and thereby open interrupter contacts 144, 146. When trip open actuator 210 is actuated, the downward force of pin 332 on camming surface 368 causes prop latch 364 to rotate clockwise and away from side link 312 so as not to interfere with the downward movement of linkage 211.

A closing bar can be used to close operator 200 by inserting the closing bar (not shown) into link 315 and applying a downward force causing counter-clockwise rotation of link 315 and side link 312 about pin 324, until prop latch 364 and side link 312 engage. Roller 334 must first be latched below roller 342 by latch 340.

Closing Mechanism 240

Figure 17:
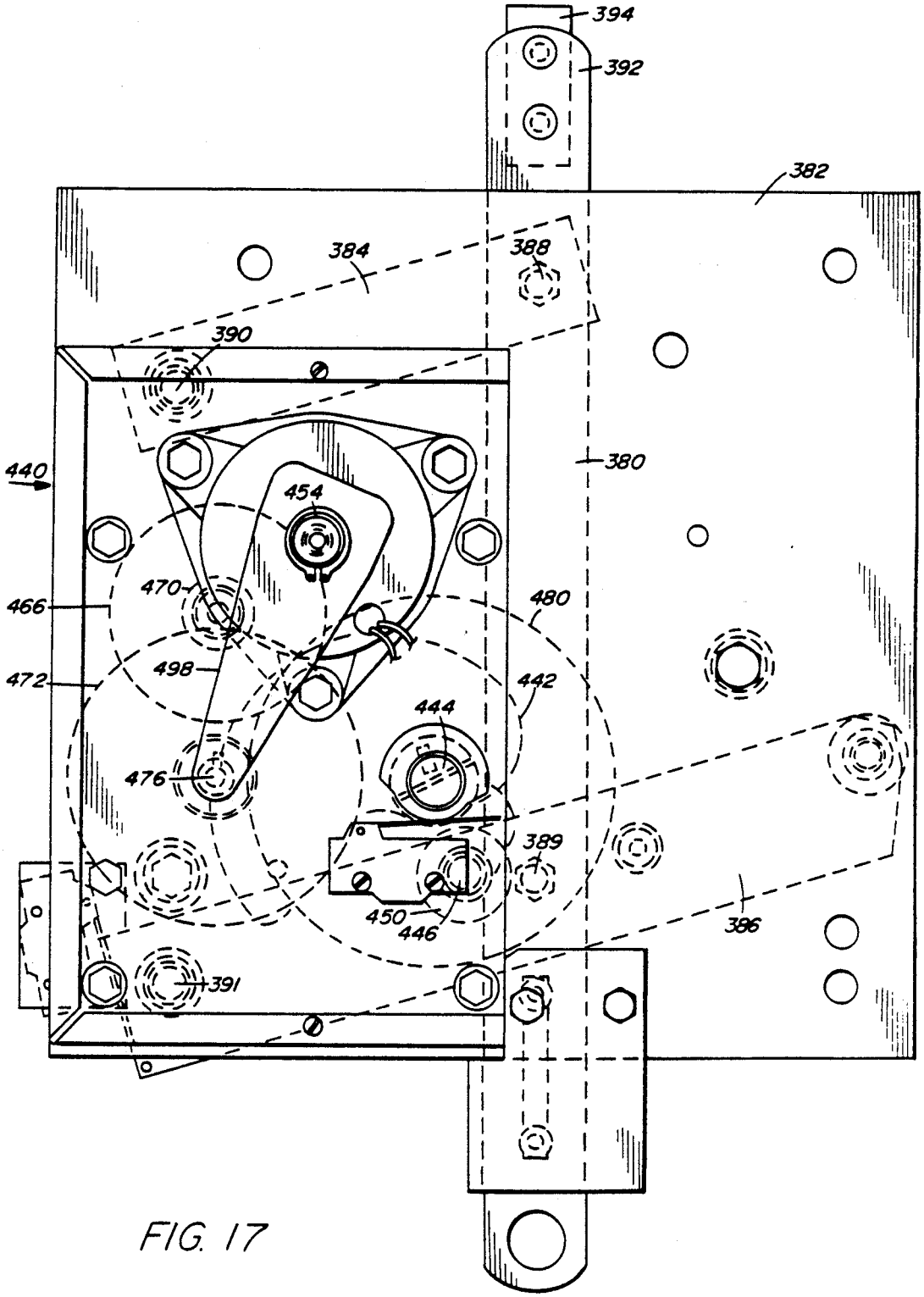
FIG. 17 shows a side elevation view of the closing mechanism of the operator of FIG. 13.
Figure 18:
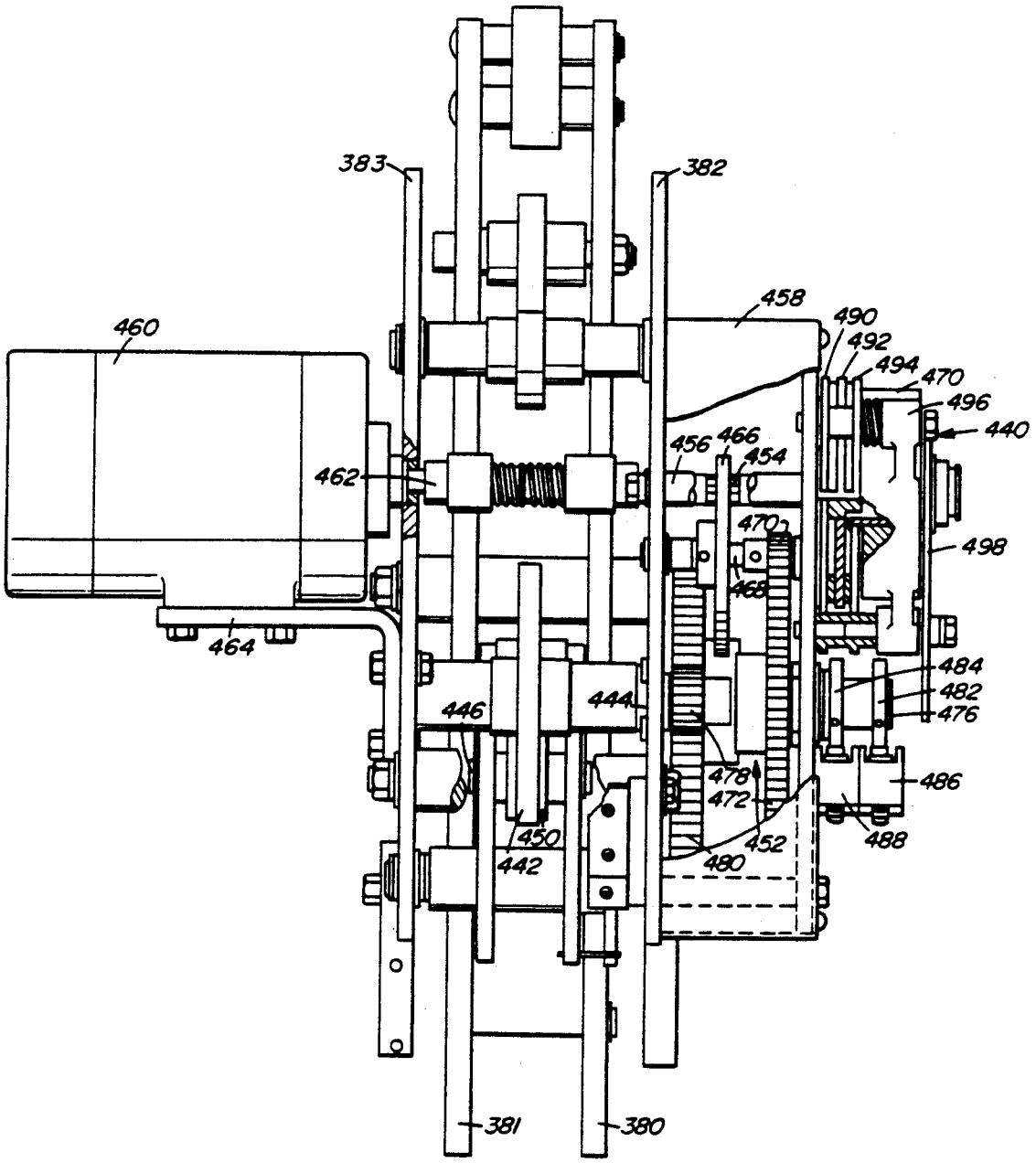
FIG. 18 shows a front view of the closing mechanism of FIG. 17.

Referring now to FIGS. 17 and 18 in conjunction with Figures 13 and 14, there is illustrated the closing mechanism 240. As shown in FIGS. 13 and 17, closing mechanism 240 includes a pair of generally vertical closing links 380 and 381 which are reciprocally mounted on parallel plates 382 and 383 respectively, Plates 382, 383 are attached to the frame 201 of housing 202. Each closing link 380, 381 is mounted on its respective support plate 382, 383 by means of an upper first lever arm 384 and a lower second lever arm 386. Lever arms 384, 386 are rotatably connected to closing links 380, 381 by cap screws 388, 389. The other ends of lever arms 384, 386 are rotatably attached to their respective support plate 382, 383 by pins 390, 391. The upper end 392 of closing link 380 includes a bearing member 394 adapted for bearing engagement with roller 330 mounted on the linkage 211 of opening mechanism 220, best shown in FIG. 13. As can be seen, the vertical upward movement of closing link 380 of closing mechanism 240 will cause the roller 330 and thus the linkage 211 of opening mechanism 220 to also move in a vertical upward direction with trip latch 340 in the latched position retarding the upward movement of roller 334. This movement will rotate triangular links 288, 289 in a counterclockwise direction as seen in FIG. 13 thus moving shaft 280 in a direction opposite the arrow to close interrupter contacts 144, 146.

Closing springs 400 provide the spring stored energy necessary to snap closing links 380, 381 upward and close interrupter contacts 144, 146. As best shown in FIG. 14, a plurality of closing springs 400 have their upper end affixed to stationary coaxially aligned bars 304 305 projecting from and rigidly attached to rectangular plates 221, 223. The other ends of springs 400 are attached to a pin 387 extending through apertures in the lower end of closing links 380, 381. In the charged position, closing links 380, 381 have been reciprocated downward by closing mechanism 240 thereby stretching or charging springs 400 to place them in tension. That end of each lower second lever arm 386 opposite pin 391 has mounted thereon a roller 390 by means of a pin 388. As described below, roller 390 is engaged by close actuator 230 whereby the close links 380, 381 are maintained in their lowermost position with the springs 400 in tension and charged until close actuator 230 is actuated allowing closing springs 400 to discharge and causing close links 380, 381 to move vertically upward.

Close Actuator 230

Figure 19:
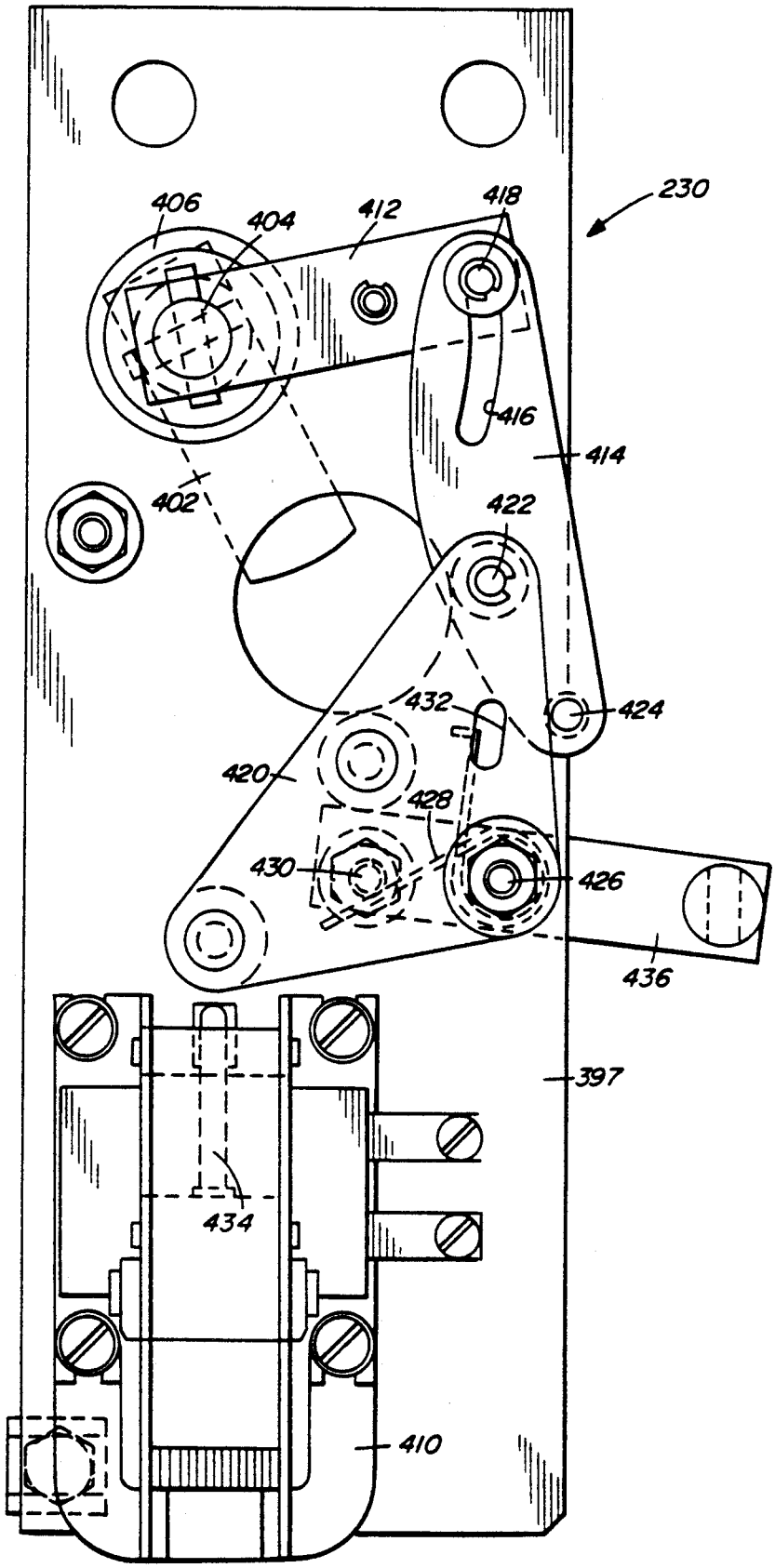
FIG. 19 shows a side elevation view of the close actuator of the operator of FIG. 13.
Figure 20:
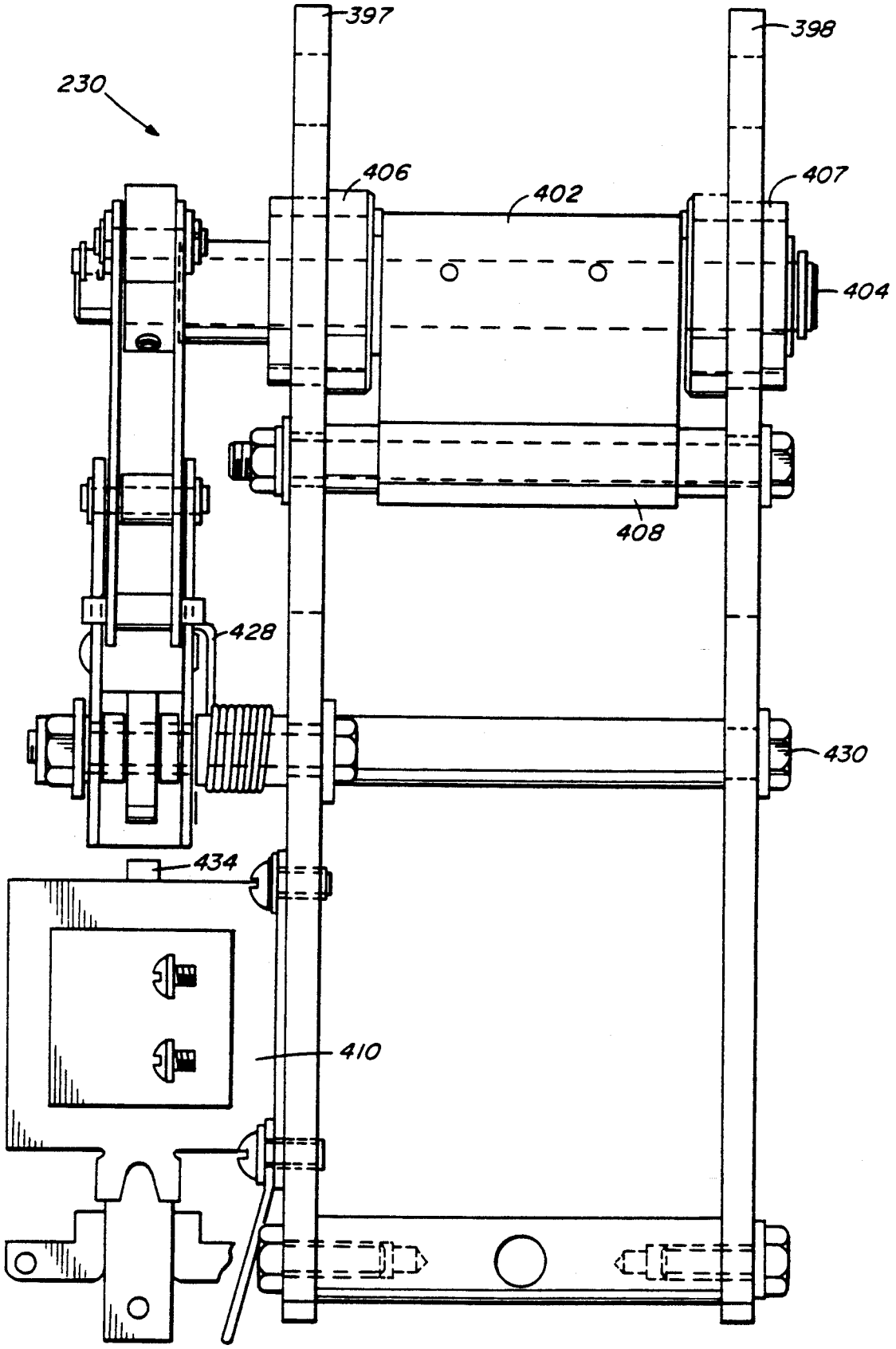
FIG. 20 shows an end view of the close actuator of FIG. 19.

Referring now to FIGS. 19 and 20, there is illustrated the close actuator 230. Close actuator 230 includes two parallel plates 397, 398 attached to frame 201 below closing mechanism 240. A closing latch 402 is rotatably mounted on a pin 404 extending through bushings 406, 407 which are mounted in apertures in plates 397, 398. Closing latch 402 includes a downwardly facing arcuate surface 408 adapted for engagement with the upper surface of a roller 390 which, as previously described, is rotatably disposed on one end of lower second lever arm 386 of closing mechanism 240.

One end of pin 404 is mounted to linkage which is in engagement with trip close solenoid 410. The linkage includes a lever arm 412 having one end mounted to pin 404 and the other end mounted to link 414. Link 414 includes a camming aperture 416 in which rides a pin 418 passing through the end of lever arm 412. A triangular link 420 has one corner rotatably mounted to link 414 by a pin 422 near the midsection of link 414. That end of link 414 opposite aperture 416 includes a stop pin 424 which bears against triangular link 420 as the linkage moves in one direction. Another corner of triangular link 420 is rotatably mounted to plate 397 by bolt 426. A spring 428 is affixed by bolt 426 to plate 397 with on end of the spring bearing against pin 430 and the other end passing through an aperture 432 in triangular link 420 to bias triangular link 42 in the counterclockwise direction.

The third corner of triangular link 420 is engaged with a plunger pin 434 of trip close solenoid 410. Upon the trip close solenoid 410 receiving a trip close signal from controller 14, pin 434 becomes extended from trip close solenoid 410 to engage the third corner of triangular link 420 and rotate link 420 in the clockwise direction. This movement, via link 414 and lever arm 412, rotates pin 404 and latch 402 to cause latch 402 to disengage roller 390 on lower second lever arm 386 of closing mechanism 240. Upon the release of lower second lever arm 386, closing springs 400 discharge, driving closing links 380, 381 upwardly to engage roller 330 in opening mechanism 220 and close the interrupter contacts 144, 146.

As shown in FIG. 19, close actuator 230 also includes a manual latch lever 436 affixed to triangular link 420 by bolt 426. Latch lever 436 may be manually rotated clockwise, allowing close actuator 230 to be operated manually as well as by means of trip close solenoid 410.

Spring Charging Mechanism 440

Referring again to FIGS. 17 and 18, the closing mechanism 240 includes a spring charging mechanism 440 for stretching closing springs 400 and placing them in tension in the charged position. A large force is required to charge closing springs 400. Further, closing springs 400 must be charged in approximately a second or less to permit an opening and closing sequence of less than two seconds. To achieve this speed, the charging mechanism 440 includes a cam 442 which rotates on a shaft 444 mounted on plates 382, 383. Cam 442 is positioned to engage a roller 450 rotatably mounted on a pin 446 mounted on lower secondary lever arms 386. As shown in FIG. 17, as cam 442 is rotated clockwise by shaft 444, the cam 442 engages roller 450 to cause lower secondary lever arms 386 to move downwardly whereby closing link 380 is moved downwardly to place closing springs 400 in tension and the charged position.

Shaft 444 is engaged with a gear train 452 which includes a pinion gear 454 on a shaft 456 extending through apertures in plates 382, 383 and connected to a spring charging motor 460 by means of a coupling 462. Charging motor 460 is mounted on plate 383 by a bracket 464. A motor brake 470 is mounted on the other end of shaft 456 and is supported by a housing 458 disposed on plate 382. The charging motor 460 rotates cam 442 via gear train 452 with brake 470 controlling the starting and stopping of the revolution of cam 442 which charges closing mechanism 240.

The gea train 452 steps down the revolutions of the spring charging motor 460 so as to rotate the cam 442 one revolution to charge closing springs 400. The gear train 452 includes pinion gear 454 which drives follower gear 466. Follower gear 466 is mounted on shaft 468 which also has mounted thereon a pinion gear 470. Pinion gear 470 drives follower gear 472 which is mounted on shaft 476. Also mounted on shaft 476 is pinion gear 478 which drives follower gear 480 that is mounted on shaft 444, the same shaft on which is mounted cam 442.

Two smaller cams 482, 484 are also mounted on shaft 476 for determining the position of larger cam 442. Cams 482, 484 engage indicator switches 486, 488. Switch 488 is a 240 volt switch which is used to start and stop charging motor 460 and actuate motor brake 470. Switch 486 is a 24 volt switch used to indicate whether closing springs 400 are charged or discharged.

Motor brake 470 includes a plate and disc assembly 490, a motor braking disc 492, and a sleeve and plate assembly 494 housed within housing 496 and mounted on shaft 456 to instantly stop the rotation of shaft 456 and cam 442 upon receiving a signal from switch 488. Brake 470 also includes a motor brake release lever 498 for manually releasing the motor brake.

The three modes of operation of operator 200 are as follows:

Fast Electrical Operation

Referring to FIGS. 13 and 18, with interrupter contacts 144 and 146 in the open position and closing springs 400 not yet charged as shown in FIG. 13, cam 484 will actuate switch 488 to provide power to the spring charging motor 460 and to release motor brake 470, thereby rotating cam 442 clockwise as viewed in FIG. 13 and charging closing springs 400. When cam 442 has made one revolution, closing springs 400 reach their charged position, roller 390 on lower second lever arm 386 becomes engaged and locked by close actuator 230, and motor brake 470 is applied and power to charging motor 460 is disconnected by actuation of switch 488 by cam 484. FIG. 21 depicts operator 200 in this position with closing springs 400 charged and latched and opening springs 300 discharged. By force of gravity and by the spring force imparted by spring 362 to second end link 316, linkage 211 of operating mechanism 220 moves downward with closing links 380, 381 as the closing springs 400 are charged, such that roller 334 on balance beam link 308 drops below roller 342 on trip latch 340 and becomes latched. With closing springs 400 thus charged and linkage 211 lowered, connecting power to the trip close solenoid 410 of close actuator 230 will cause the discharge of closing springs 400 and propel closing links 380, 381 upwardly against roller 330 of opening mechanism 220 so as to propel drive bar 280 in the direction of the arrow shown in FIG. 22, and thereby, in cooperation with interrupter actuator 120, cause moveable contact 144 in interrupter 100 to engage stationary contact 146. As closing springs 400 discharge, opening springs 300 are automatically charged by linkage 211 of opening mechanism 220, operator 200 now being in the position shown in FIG. 22.

Referring to FIG. 22, to thereafter open interrupter contacts 144, 146, connecting power to trip open solenoid 218 of open actuator 210 releases trip latch 340 allowing opening springs 300 to discharge as balance beam link 308 rotates clockwise. This action propels drive bar 280 in the direction of the arrow in FIG. 13, thereby opening contacts 144, 146.

Fast Manual Operation

Assuming interrupter contacts 144, 146 are in their engaged or closed position, opening springs 300 will be fully charged as shown in FIG. 22. Operator 200 may then be manually actuated to open the interrupter contacts 144, 146 by rotating manual pull link 254 of open actuator 210 such that trip latch 340 is released allowing opening springs 300 to discharge, operator 200 then being in the position shown in FIG. 13. To manually fast close the interrupter contacts 144, 146, closing springs 300 must first be charged by spring charging mechanism 440 or by use of a closing bar (not shown) that is inserted into link 315 of opposing mechanism 220. Thereafter, with operator 200 in the position shown in FIG. 21, operator 200 can be actuated to manually close interrupter contacts 144, 146 by rotating manual latch lever 436 of close actuator 230. As closing springs 400 are discharged, interrupter contacts 144 and 146 engage and the opening springs 300 are charged.

Slow Manual Operation

With interrupter contacts 144, 146 closed and closing springs 400 discharged, opening spring 300 will be charged, as shown in FIG. 22, and operator 200 can be manually actuated to slowly open interrupter contacts 144, 146 by releasing motor break release lever 498 and manually rotating pinion 454 clockwise as viewed in FIG. 17 until prop latch 364 and side link 312 of opening mechanism 220 are unlatched prop latch 364 is then manually rotated away from side link 312, and motor break release lever 498 is released. Pinion 454 is then manually rotated counter-clockwise until the interrupter contacts 144, 146 are open. This operation will partially charge the closing springs 400 without latching, and then will discharge them.

To manually slow-close the mechanism, the closing springs 400 must first be charged using spring closing mechanism 240. Motor break release lever 498 is first released and pinion 454 is manually rotated clockwise as viewed in FIG. 17. The pinion 454 and gear train 452 will rotate freely until cam 442 engages roller 450 on closing mechanism 240. As pinion 454 continues to rotate, closing springs 400 are charged and closing latch 402 holds the spring load as the roller 450 clears cam 442.

With the closing springs 400 charged, the operator 200 can be closed in two ways, either by using a closing bar or by slowly discharging the closing springs 400. A closing bar can be used to slow-close interrupter contacts 144, 146 by inserting the bar into link 315 and employing a downward force until the prop latch 364 and side link 312 latch. Roller 334 must first be latched by latch 340.

Alternatively, interrupter contacts 144, 146 can be closed by slowly discharging the closing springs 400 by first releasing motor break release lever 498 and manually rotating the pinion 454 clockwise as viewed in FIG. 17 until the roller 450 on closing mechanism 240 engages the cam 442 and lifts roller 390 off of closing latch 402. Latch 402 is then rotated away from roller 390 and pinion 454 is manually rotated counter-clockwise until the close mechanism 240 closes and the prop latch 364 and side link 31 latch.

While a preferred embodiment of the invention has been shown and described, modifications thereof can be made by one of ordinary skill in the art without departing from the spirit of the invention.

I claim:

1. A circuit recloser, comprising:

a circuit interrupter for interrupting current flow, said interrupter including:

a housing containing an arc-extinguishing media therein;

a pair of electrical contacts disposed within said housing, at least one of said contacts being movable within said housing between a closed position where it is in electrical contact with said other contact and an opened position where it is separated from said other contact forming a gap such that an arc may form therebetween; and means for injecting a flow of said arc-extinguishing media into said gap as said contacts are moved into the opened position; and operator means for moving said interrupter contacts from the closed position to the opened position and for reclosing the contacts after a predetermined interval.

2. The circuit recloser of claim 1 wherein each of said pair of contacts conducts the current flowing through said interrupter as said contacts are moved between the opened and closed position and when said contacts are in the closed position.

3. The circuit recloser of claim 2 wherein said interrupter includes means on one of said contacts for engaging said other contact and for conducting current flow between said contacts, said engaging means comprising a plurality of projecting contact fingers.

4. The circuit recloser of claim 3 wherein said contact fingers include arcing tips for conducting current between said contacts as said contacts are moved between the opened and closed positions.

5. The circuit recloser of claim 3 wherein said contact fingers include raised portions for contacting said other contact and for conducting current between said contacts when said contacts are closed.

6. The circuit recloser of claim 5 wherein said contact fingers include arcing tips and wherein said raised portions on said fingers cause said arcing tips to disengage said other contact as said contacts are moved into the closed position by said operator.

7. The recloser of claim wherein said operator means includes:

linkage connected to said contacts for moving said contacts between the opened and closed positions, said linkage having a first position for moving said contacts to the open position and a second position for moving said contacts to the closed position;

opening force means for moving said linkage to the first position; and closing force means for moving said linkage to the second position.

8. The recloser of claim 7 wherein said opening force means and said closing force means include a plurality of springs engaging said linkage for applying a force to said linkage.

9. The recloser of claim 1 wherein said operator means includes an actuator shaft extending through said interrupter housing and connected to at least one of said contacts for moving said contacts between the opened and closed positions, said recloser further comprising:

a seal assembly for sealing said actuator shaft and said housing and retaining said arc-extinguishing media within said housing.

10. The recloser of claim 9 wherein said seal assembly comprises bearing means for providing rotational support for said shaft.

11. The recloser of claim 10 wherein said bearing means includes a plurality of bushings having nonmetallic bearing surfaces.

12. The recloser of claim 10 wherein said seal assembly further comprises:

a housing module having an axially bore therethrough, said actuator shaft being disposed within said bore;

a first seal means for sealing said module to said interrupter housing;

a second seal means for sealing said module to said shaft; and means for attaching said module to said interrupter housing.

13. The recloser of claim 12 wherein said housing module comprises:

a seal housing module having an upper surface and having a groove formed on said upper surface for securing said first seal means against said interrupter housing;

a bearing housing module;

means for securing said second seal means between said bearing housing module and said seal housing module; and means for attaching said bearing housing module to said seal housing module.

14. The recloser of claim 1 further comprising bushings mounted on said interrupter housing for conducting current to and from said contacts, said bushings including a cavity in fluid communication with the interior of said interrupter housing, said arc-extinguishing media extending from within said housing to within said cavity.

15. A circuit interrupter for interrupting current flow, comprising:

an electrical connection for current flow including movable contacts having an open position preventing current flow and a closed position allowing current flow;

a housing for enclosing said electrical connection, said housing containing an arc-extinguishing media around said electrical connection;

conductors disposed on bushings mounted on said housing for carrying current to and from said movable contacts;

an operator connected to said movable contacts for moving said movable contacts between said open and closed positions;

an open actuator for actuating said operator to move said movable contacts to said open position;

a close actuator for actuating said operator to move said movable contacts to said closed position; and a resetting mechanism for resetting said operator between said open and close positions.

16. The circuit interrupter of claim 15 wherein said operator includes linkage connected to said movable contacts, said linkage having a first position for moving said movable contacts to said open position and a second position for moving said movable contacts to said closed position.

17. The circuit interrupter of claim 16 wherein said operator further includes an opening force means for moving said linkage to said first position and a closing force means for moving said linkage to said second position.

18. The circuit interrupter of claim 17 wherein said opening and closing force means include a plurality of springs engaging said linkage for applying a force to said linkage.

19. The circuit interrupter of claim 16 wherein said open actuator includes a movable latch having a latching position and an unlatching position, said movable latch engaging said linkage in said latching position to prevent said linkage from moving to said first position and disengaging said linkage in said unlatching position to allow said linkage to move to said first position.

20. The circuit interrupter of claim 19 wherein said open actuator includes trip means for moving said movable latch from said latching position to said unlatching position to allow said linkage to move to said first position and open said movable contacts.

21. The circuit interrupter of claim 20 wherein said open actuator includes link members engaging said movable latch and a solenoid connected to said link members to actuate said link members and move said movable latch to said unlatching position.

22. The circuit interrupter of claim 21 wherein said solenoid is electrically connected to means for detecting circuit faults.

23. The circuit interrupter of claim 20 wherein said open actuator includes a manual lever connected to movable links attached to said movable latch for moving said movable latch to said unlatching position.

24. The circuit interrupter of claim 20 wherein said open actuator includes a rotatable arm holding said movable latch in said latching position and means for rotating said rotatable arm whereby said arm no longer holds said movable latch and said movable latch can move to said unlatching position.

25. The circuit interrupter of claim 24 wherein said rotatable arm includes weights for balancing said rotatable arm about the point of rotation of said arm.

26. The circuit interrupter of claim 16 further including a reciprocable drive bar engaging said linkage, said drive bar being reciprocable between a charged position and a discharged position, said drive bar being in said charged position when said linkage is in said second position and in said discharged position when said linkage is in said first position, said drive bar moving said linkage from said first position to said second position as said drive bar reciprocates from said charged position to said discharged position whereby said contacts are closed.

27. The circuit interrupter of claim 26 further including a closing spring mounted on said housing and having one end attached to said drive bar, said spring applying a closing force to said drive bar in said charged position.

28. The circuit interrupter of claim 16 wherein said close actuator includes a movable latch having a latching position and an unlatching position, said movable latch engaging said drive bar in said latching position to prevent said linkage from moving to said second position and disenqaqinq said linkage in said unlatching position to allow said linkage to move to said second position.

29. The circuit interrupter of claim 19 wherein said close actuator includes trip means for moving said movable latch from said latching position to said unlatching position to allow said drive bar to move to said discharging position and close said movable contacts.

30. The circuit interrupter of claim 29 wherein said close actuator includes link members engaging said movable latch and a solenoid connected to said link members to actuate said link members and move said movable latch to said unlatching position.

31. The circuit interrupter of claim 30 wherein said solenoid is electrically connected to program means for actuating said close actuator after said contacts have been open a predetermined period of time.

32. The circuit interrupter of claim 29 wherein said close actuator includes a manual lever connected to movable links attached to said movable latch for moving said movable latch to said unlatching position.

33. The circuit interrupter of claim 26 wherein said resetting mechanism includes a cam engageable with said drive bar for reciprocating said drive bar to said charged position.

34. The circuit interrupter of claim 33 wherein said resetting mechanism further includes motor means with a gear train connected to said motor means and said cam for rotating said cam.

35. The circuit interrupter of claim 34 wherein said gear train steps down the revolutions of said motor means to rotate said cam one revolution.

36. The circuit interrupter of claim 35 wherein said resetting mechanism further includes brake means associated with said motor means for stopping said motor means after said cam has rotated one revolution.

37. The circuit interrupter of claim 34 wherein said resetting mechanism includes indicator means for determining the position of said cam and signaling said brake means after said cam has revolved one revolution.

38. The circuit interrupter of claim 33 wherein said resetting mechanism includes a manual lever engageable by link members with said cam for manually reciprocating said drive bar.

39. The circuit interrupter of claim 15 wherein said arc-extinguishing media is sulfur hexofluoride gas.

40. The circuit interrupter of claim 39 wherein said gas serves as a dielectric shield around said connection to prevent flash over.

41. The circuit interrupter of claim 15 wherein said bushings include a weathershed molded about said conductor for mounting said conductor to said housing and for insulating said conductor from said housing.

42. The circuit interrupter of claim 41 wherein said weathershed is molded from epoxy resin and includes a series of concentric skirts.

43. The circuit interrupter of claim 41 wherein said weathershed includes a base having a circular groove housing a seal ring for sealing between said bushing and said housing.

44. The circuit interrupter of claim 41 wherein said bushing includes a secondary ground around a portion of said conductor.

45. The circuit interrupter of claim 41 wherein said weathershed includes a cavity opening into said housing, said arc-extinguishing media extending from within said housing to within said cavity.

46. The circuit interrupter of claim 15 wherein said movable contacts include a stationary contact and a reciprocable contact.

47. The circuit interrupter of claim 46 wherein said reciprocable contact and stationary contact are mounted on terminals which are in electrical engagement with said conductors.

48. The circuit interrupter of claim 47 wherein said electrical connection is disposed between said terminals housed within said housing, said terminals forming a dielectric chamber for said electrical connection.

49. The circuit interrupter of claim 48 wherein said reciprocable contact includes a shaft slidingly received by an aperture in one of said terminals for reciprocation of said shaft within said aperture and of said reciprocable contact within said dielectric chamber.

50. The circuit interrupter of claim 46 wherein said reciprocable contact includes a plurality of projecting fingers adapted for engagement with said stationary contact in said closed position.

51. The circuit interrupter of claim 50 wherein said fingers are laterally flexible and flex upon engagement with said stationary contact.

52. The circuit interrupter of claim 51 wherein said contacts include arcing tips.

53. The circuit interrupter of claim 48 wherein said reciprocable contact includes a piston.

54. The circuit interrupter of claim 53 wherein said piston slidingly seals with the interior of said housing.

55. The circuit interrupter of claim 53 wherein said reciprocable contact includes a plenum extending over said electrical connection to form an arcing chamber around said connection and a compression chamber in that portion of said dielectric chamber between one terminal and said piston.

56. The circuit interrupter of claim 55 wherein said piston includes a gas port extending between said arcing chamber and said compression chamber allowing said media to flow therebetween.

* * * * *